US012139976B2

(12) United States Patent
Tiberi et al.

(10) Patent No.: US 12,139,976 B2
(45) Date of Patent: Nov. 12, 2024

(54) STABILIZATION MANIPULATOR FOR MOVING DRILLING ELEMENTS IN A DRILLING RIG, MANIPULATION SYSTEM AND DRILLING RIG

(71) Applicant: DRILLMEC S.P.A., Gariga di Podenzano (IT)

(72) Inventors: Andrea Tiberi, Magnolia, TX (US); Adolfo Basile, The Woodlands, TX (US)

(73) Assignee: DRILLMEC S.P.A., Gariga di Podenzano (IT)

( * ) Notice: Subject to any disclaimer, the term of this patent is extended or adjusted under 35 U.S.C. 154(b) by 0 days.

(21) Appl. No.: 18/246,616

(22) PCT Filed: Sep. 22, 2021

(86) PCT No.: PCT/IB2021/058625
§ 371 (c)(1),
(2) Date: Mar. 24, 2023

(87) PCT Pub. No.: WO2022/064374
PCT Pub. Date: Mar. 31, 2022

(65) Prior Publication Data

US 2023/0392455 A1 Dec. 7, 2023

(30) Foreign Application Priority Data

Sep. 24, 2020 (IT) ..... 102020000022486

(51) Int. Cl.
*E21B 19/15* (2006.01)
*E21B 19/24* (2006.01)

(52) U.S. Cl.
CPC ..... *E21B 19/155* (2013.01); *E21B 19/24* (2013.01)

(58) Field of Classification Search
CPC ..... E21B 19/155; E21B 19/24; E21B 19/00; E21B 19/14; E21B 19/15; E21B 19/16; E21B 19/165; E21B 19/20
(Continued)

(56) References Cited

U.S. PATENT DOCUMENTS 8,747,045 B2 6/2014 Belik
9,863,194 B2 1/2018 Larkin
(Continued)

FOREIGN PATENT DOCUMENTS

CN 107859493 * 2/2020 ..... E21B 19/14
WO WO 2019/207493 * 10/2019 ..... E21B 19/14
WO 2020/060415 A1 3/2020

OTHER PUBLICATIONS

International Search Report and Written Opinion for PCT/IB2021/058625 (Nov. 8, 2021).

*Primary Examiner* — Lynn E Schwenning
(74) *Attorney, Agent, or Firm* — Merchant & Gould P.C.

(57) ABSTRACT

A stabilization manipulator for manipulating and moving drilling elements in a drilling rig includes a linear guide fixed to a drill floor; a carriage having a base and sliding blocks, sliding along the linear guide between a positions close to and distant from a well; a first arm having a first end constrained to the carriage base, to rotate about a horizontal axis; and a separate second arm having a first end constrained to the carriage base, to rotate about a horizontal axis. A roller is constrained to the first arm second end, to rotate about an axis substantially perpendicular to the first arm, changing position relative to the first arm. A roller is constrained to the second arm second end, to rotate about an axis substantially perpendicular to the second arm, changing position relative to the second arm. A rotation system rotates the base about a vertical axis.

13 Claims, 11 Drawing Sheets

(58) Field of Classification Search
USPC ..... 414/22.51–22.71
See application file for complete search history.

(56) References Cited

U.S. PATENT DOCUMENTS

| | | | | |
|---|---|---|---|---|
| 10,012,039 | B2 * | 7/2018 | Guerra | E21B 19/155 |
| 10,294,739 | B2 | 5/2019 | Orr et al. | |
| 10,323,473 | B2 | 6/2019 | Magnuson et al. | |
| 2018/0334865 | A1 | 11/2018 | Miller et al. | |
| 2020/0199949 | A1 | 6/2020 | Magnuson | |

* cited by examiner

STABILIZATION MANIPULATOR FOR MOVING DRILLING ELEMENTS IN A DRILLING RIG, MANIPULATION SYSTEM AND DRILLING RIG

This application is a National Stage Application of PCT/IB2021/058625 filed Sep. 22, 2021, which claims priority to application Ser. No. 10/202,0000022486, filed Sep. 24, 2020, in Italy, and which applications are incorporated herein by reference. To the extent appropriate, a claim of priority is made to each of the above disclosed applications.

BACKGROUND OF THE INVENTION

The present invention relates to a stabilization manipulator capable of cooperating with another manipulator for moving drilling elements, such as drill pipes or well protection elements, in different operating configurations of the drilling rig.

The present invention also relates to a manipulation system for drilling rigs, which can eliminate the human component from the drill floor and from the fingerboard where drilling elements are stored.

The present invention further relates to an innovative drilling rig comprising the stabilization manipulator and/or the manipulation system according to the present invention.

Drilling rigs are known which comprise a plurality of auxiliary manipulators, each one suitably designed to perform a specific auxiliary function complementing another manipulator, wherein such auxiliary manipulators are located in a specific area of the drilling rig.

Patent application WO2020060415A1 describes a vehicle having a base, a drive apparatus capable of moving the vehicle across the drill floor. On such base there is an anthropomorphic arm for handling a drill pipe. This solution describes, therefore, the use of a very expensive and complex anthropomorphic arm.

It is also known from U.S. Pat. No. 9,863,194B2 a stabilizer capable of cooperating with an engagement head for setting the drill pipes in an initial position, where they can then be grasped by the engagement head, in addition to accompany the drill pipe as it is raised from a horizontal position, or initial position, to a vertical position. Such stabilizer comprises a first arm and a second arm suitably hinged to each other. The first arm is constrained to the drill floor and cannot change position. With this solution, such stabilizer is only allowed to cooperate in handling the drill pipes within a limited area proximate to the wells.

U.S. patent Ser. No. 10/323,473B2 describes a system for manipulating drill pipes or stands on the drill floor. Such system can only move drill pipes from a well towards a fingerboard, and vice versa, since it cannot be used for moving a single drill pipe, e.g. for raising it from a horizontal position to a vertical position, and vice versa.

U.S. Pat. No. 8,747,045B2 describes an articulated arm, preferably fixed to the mast structure, which can cooperate in stabilizing one or more drill pipes in proximity to a well. Such arm can take a working position, in which it cooperates in stabilizing the drill pipe, and an idle position, in which it does not hinder the movements of the other systems included in the drilling rig. This solution can only be used for stabilizing drill pipes in proximity to the well.

Patent application US2018334865A1 describes a pipe handling system that comprises a vehicle for moving stands of drill pipes. Such vehicle can seize an end of the stand to cooperate in moving it from a well to a fingerboard, and vice versa. Such vehicle cannot cooperate with another manipulator to raise the drill pipe from a horizontal position to a vertical position and vice versa.

U.S. patent Ser. No. 10/294,739B2 describes an articulated arm, preferably fixed to the mast structure, which can cooperate in stabilizing one or more drill pipes in proximity to a well. Such arm can take a working position, in which it cooperates in stabilizing the drill pipe, and an idle position, in which it does not hinder the movements of the other systems included in the drilling rig. The distal end of the arm may comprise a set of rollers that, being appropriately driven, can push or hold a drill pipe. This solution can only be used for stabilizing drill pipes in proximity to the well.

It is known, from the patent application CN107859493A a multifunctional drilling-floor-face pushing and guiding manipulator which comprises X-direction travelling tracks. An X-direction travelling pulley capable of horizontally sliding in a reciprocating mode is arranged on the X-direction travelling tracks in a matched mode, Y-direction travelling tracks perpendicular to the X-direction travelling tracks are fixed to the upper portion of the X-direction travelling pulley, and a Y-direction travelling pulley capable of horizontally sliding in a reciprocating mode is arranged on the Y-direction travelling tracks in a matched mode. A horizontal rotating mechanism is fixed to the upper portion of the Y-direction travelling pulley, and a pushing arm and a guiding righting arm which can rotate in the vertical surface are connected to the upper portion of the horizontal rotating mechanism. The guiding righting arm is located on the upper portion of the pushing arm, the other end of the pushing arm is rotatably connected with a righting device, and the other end of the guiding righting arm is rotatably connected with a guiding righting roller.

It is also known by the patent application US 2020199949A1 an apparatus for moving a tubular including: a column vertically extending from a drill floor, the column defining an axis; a lower carriage connected to the column and configured to carry the column along the drill floor; an upper arm assembly movable along the column, the upper arm assembly being configured to connect with a tubular; and a lower arm assembly having a lower gripper head configured to attach to the tubular, the lower arm assembly being movable to displace the lower gripper head between a position on a first side of the axis and a position on a second side of the axis.

No stabilization manipulators are known which can cooperate with another manipulator both for "off-line" operations, i.e. during procedures not directly connected to drilling, such as assembling or disassembling a drill stand from ground level to the fingerboard or magazine, and for the feeding operation occurring during the drilling process, i.e. for moving the drill pipes, e.g. in the form of a stand of pipes, from the fingerboard or magazine to the well centre or to the secondary well, so that they can be picked up and used during the drilling operations, and vice versa.

Furthermore, said stabilization manipulator should not be excessively costly, and it would be too expensive to use an anthropomorphic arm on a carriage to perform such stabilization functions. Moreover, anthropomorphic arms would be too demanding on the specifications of the stabilization manipulator.

Simple, low-cost manipulator solutions are exclusively intended for providing a stabilization function in specific areas of the drill floor, and hence for specific functions of the drilling rig.

SUMMARY OF THE INVENTION

The present invention intends to solve all the above-mentioned technical problems as well as other technical problems known to a person skilled in the art.

In particular, the present invention aims at providing a stabilization manipulator capable of cooperating in stabilizing the drilling elements as they are handled, both during procedures not directly connected to the drilling process, such as, for example, assembling or disassembling a stand of drilling elements, e.g. drill pipes, from ground level to the fingerboard or a magazine, and during the feeding phase occurring during the drilling process, wherein such stabilization manipulator is not costly, can be manufactured easily, and can reduce the occupied space when it is inoperative.

The present invention also intends to reduce the number of human operators, and in particular to eliminate the need for any of them, by automating the pipe handling process by means of an innovative manipulation system.

One aspect of the present invention relates to a stabilization manipulator.

A further aspect of the present invention relates to a manipulation system.

Yet another aspect of the present invention relates to a drilling rig.

BRIEF DESCRIPTION OF THE DRAWINGS

The features and advantages of the manipulator, system and rig will become apparent in the light of the following description of some preferred embodiments and of the annexed drawings, wherein:

FIG. 1A shows a perspective front view of the stabilization manipulator; FIG. 1B shows a side view of the stabilization manipulator.

FIG. 2A shows the stabilization manipulator in a second operating configuration; FIG. 2B shows the stabilization manipulator in the first operating configuration; FIG. 2C shows the stabilization manipulator in a third operating configuration;

FIG. 3A shows a perspective front view of the stabilization manipulator; FIG. 3B shows a side view of the stabilization manipulator;

FIG. 4A shows a plan view from above of the stabilization manipulator; FIG. 4B shows a side view of the stabilization manipulator;

FIG. 5A shows a plan view from above of the stabilization manipulator; FIG. 5B shows a side view of the stabilization manipulator;

FIG. 6A shows a perspective front view of the stabilization manipulator; FIG. 6B shows a side view of the stabilization manipulator;

FIG. 7A shows a perspective front view of the stabilization manipulator in an eighth operating configuration; FIG. 7B shows a perspective front view of the stabilization manipulator in a ninth operating configuration;

FIG. 8A shows the phase of grasping a drilling element, e.g. a drill pipe, that has been placed on the drill floor by a lifting device or catwalk; FIG. 8B shows the positioning of the drilling element in a secondary well or mousehole by means of a multifunction manipulator; FIG. 8C shows the positioning of a stand of drilling elements at the well centre from two viewpoints, one illustrating the multifunction manipulator and the other illustrating the stabilization manipulator;

FIG. 8D shows the positioning of a stand of drilling elements in a housing of a fingerboard for stands of drilling elements from two viewpoints, one illustrating the multifunction manipulator and the other illustrating the stabilization manipulator;

Figure 1A:
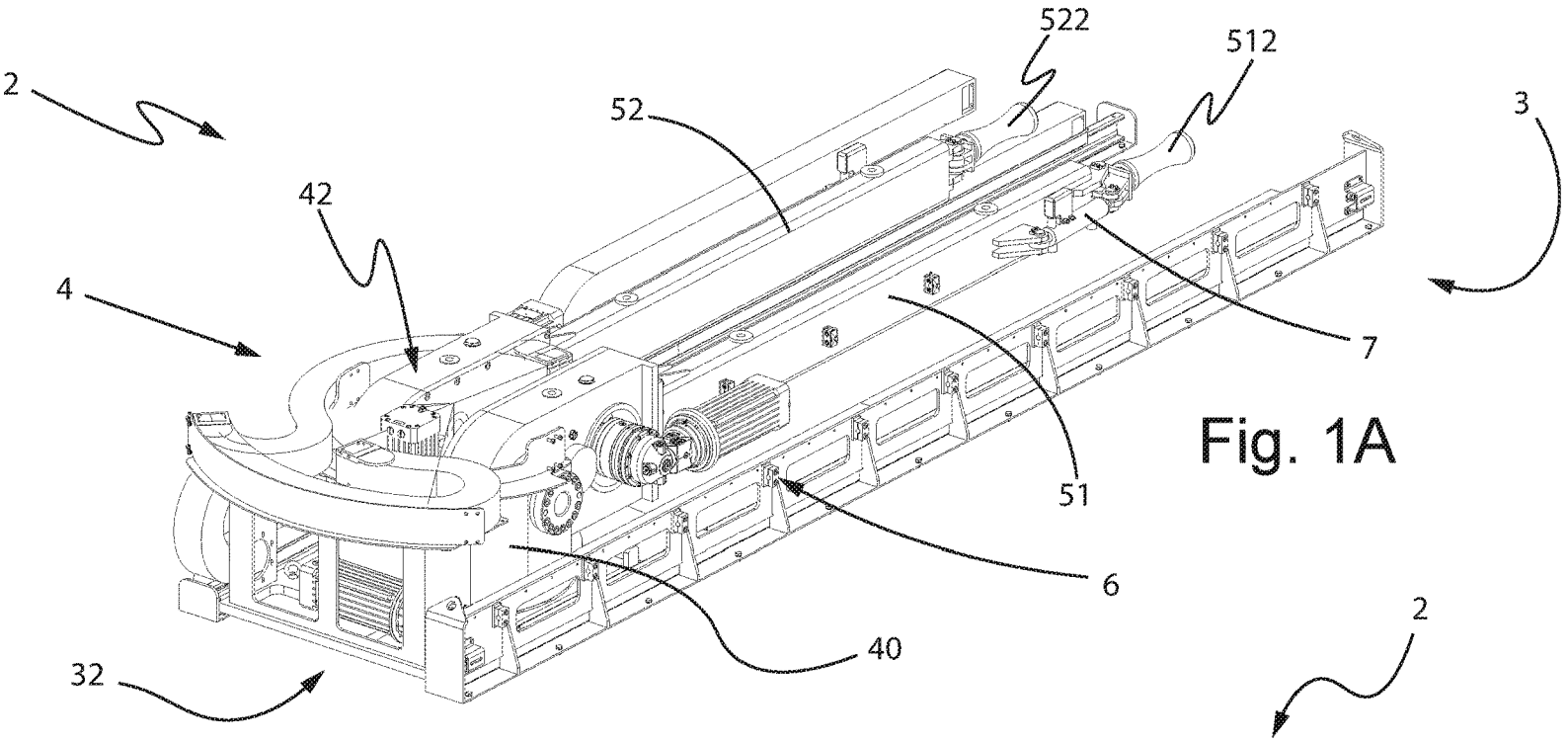
FIGS. 1A and 1B show, in a first operating configuration, one possible embodiment of the stabilization manipulator according to the present invention; in particular.

With reference to the above-mentioned figures, reference numeral 2 designates as a whole the stabilization manipulator according to the present invention; whereas reference numeral 1 designates the drilling rig, in which the whole manipulator is comprised. Lastly, reference numeral 8 identifies the multifunction manipulator comprised in the manipulation system.

Stabilization manipulator 2 is particularly suitable for cooperating, e.g. with another manipulator, preferably a multifunction manipulator 8, in handling and moving drilling elements "P" in a drilling rig 1, particularly for assembling, disassembling and moving a stand "S" of drilling elements "P", both when such drilling elements "P" or stands "S" are substantially vertical and when they are substantially horizontal.

For the purposes of the present invention, the term drilling elements "P" may refer to drill pipes, drill collars and heavy-weight drill pipes, as well as to well casings, junction elements or subs and, more generally, to one or more elements substantially cylindrical in shape.

In the following, the term drilling elements will be used for simplicity's sake to refer, without distinction, to pipes, casings and/or subs, etc. used in drilling rigs, unless otherwise specified.

Stabilization manipulator 2 according to the present invention cooperates in handling and moving drilling elements "P" in a drilling rig 1. In particular, stabilization manipulator 2 comprises: a linear guide 3 adapted to be fixed on a drill floor 13 comprised in the drilling rig 1; and a carriage 4, comprising a base 40 and sliding blocks, e.g. roller-equipped ones. Said carriage 4 is adapted to slide along said linear guide 3 to move at least between a position close to a well (M, H), e.g. a secondary well "M" or a well centre "H", or proximal position, and a position distant from said well (M, H), or distal position. Therefore, the stabilization manipulator lies on drill floor 13 and moves linearly, preferably along the entire extension of a region of drill floor 13 intended to house drilling elements "P" or stands "S", referred to as setback.

Stabilization manipulator 2 according to the present invention further comprises: a first arm 51 and a second arm 52. Said first arm 51 is constrained to a first end of said base 40 of carriage 4 to be able to rotate about a horizontal axis, being rotatably constrained. Said second arm 52 is also constrained to a first end of said base 40 of carriage 4 to be able to rotate about a horizontal axis, being rotatably constrained.

Said second arm 52 is separate from and independent of said first arm 51. The implementation of two independent and separate arms makes it possible to broaden the functionality of stabilization manipulator 2.

In a preferred embodiment of said arms (51, 52), each one of them is a monolithic arm, preferably straight.

In stabilization manipulator 2 according to the present invention, a roller 512 is constrained to the second end of said first arm 51. Said roller 512 is adapted to rotate, preferably to oscillate, about an axis substantially perpendicular to the extension, in particular the longitudinal extension, of said first arm 51, changing position relative to said first arm 51. Likewise, a roller 522 is constrained to the second end of said second arm 52.

Said roller 522 is adapted to rotate, preferably to oscillate, about an axis substantially perpendicular to the extension, preferably the longitudinal extension, of said second arm 52, changing position relative to said second arm 52.

The use of rollers (512, 522) located at the ends of the arms (51, 52) of stabilization manipulator 2 prevents said stabilization manipulator 2 from holding drilling elements "P", so that drilling element "P", which is held at its other end by a multifunction manipulator 8, will not be held in a hyperstatic manner, thus facilitating the handling of drilling elements "P" and not subjecting the manipulation system, in particular multifunction manipulator 8 and stabilization manipulator 2 according to the present invention, as well as drilling element "P", to any structural stress.

In the preferred embodiment of stabilization manipulator 2, said carriage 4 comprises a rotation system 42. Said rotation system 42 is adapted to cause said base 40 to rotate about a vertical axis, preferably normal to the surface defined by said drill floor 13, by approximately 180°.

Stabilization manipulator 2 according to the present invention turns out to be compact, easy to implement, and capable of cooperating in different operating configurations of drilling rig 1, thereby considerably cutting down costs compared with a vehicle-mounted anthropomorphic arm as used in the prior art.

In a preferred embodiment of stabilization manipulator 2 according to the present invention, said rotation system 42 is adapted to cause said base 40 to rotate, preferably to oscillate, by an angle comprised between 0° and 200°, preferably between 0° and 180°, about a vertical axis. Said vertical axis is preferably normal to the surface defined by said drill floor 13.

Figures 2A, 2B, 2C:
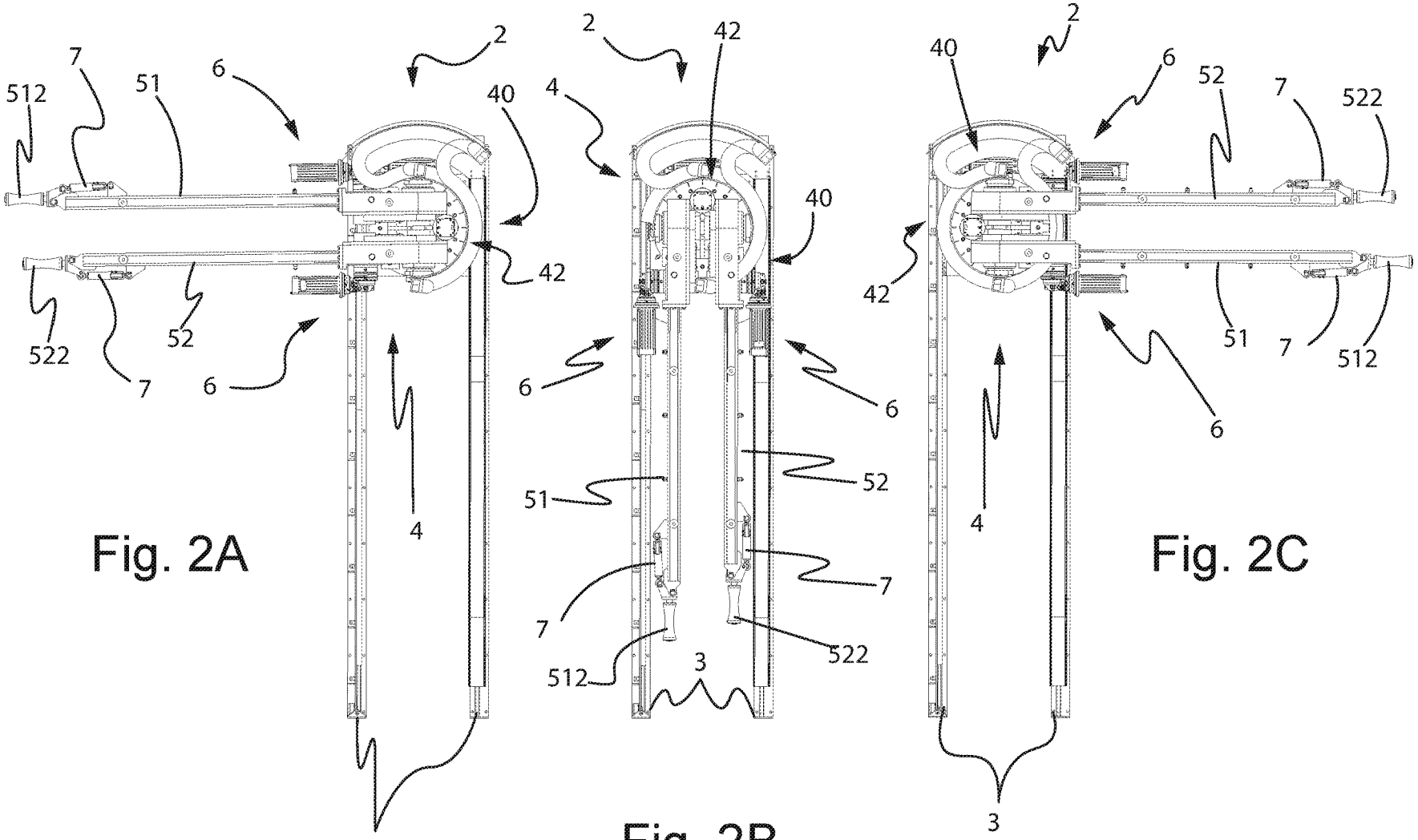
FIGS. 2A, 2B and 2C show the stabilization manipulator of FIGS. 1A and 1B in a plan view from above, in different possible operating configurations; in particular.

More in general, the rotation ability of base 40 allows for properly orienting the arms (51, 52) of stabilization manipulator 2 to cooperate in moving one or more drilling elements "P". Preferably, said rotation system permits rotating said base 40 by 90° in one direction of rotation relative to said linear guide 3 and by 90° in the opposite direction of rotation relative to said linear guide 3. By way of example, FIGS. 2A, 2B and 2C show a sequence of rotations effected by said rotation system 42 in order to rotate said base 40 by 180°.

In one possible embodiment, said rotation system 42 comprises a slewing ring, in turn comprising a rack, which is rotatably driven by an electric actuator, e.g. an electric motor.

In a preferred embodiment of stabilization manipulator 2 according to the present invention, each arm (51, 52) comprises a respective handling device 6. Each handling device 6 is adapted to rotate the corresponding arm (51, 52) by 120° at most, e.g. approximately 100°, preferably between 0° and 90°, relative to said base 40 about a horizontal axis. This rotation ability of each arm (51, 52), independently of the other arm (52, 51) of stabilization manipulator 2, allows the latter to cooperate in handling and moving one or more drilling elements "P" in different operating configurations of drilling rig 1.

Preferably, each arm can assume any position between a horizontal position, parallel to said linear guide 3, i.e. forming an angle of 0° relative to linear guide 3 or drill floor 13, and a raised position, forming an angle of approximately 90° relative to linear guide 3 or drill floor 13.

In one possible embodiment, each handling device 6 comprises an actuator, preferably an electric one, adapted to activate a kinematic mechanism capable of causing the corresponding arm (51, 52) to rotate, preferably to oscillate.

In a preferred embodiment, each handling device 6 can move the corresponding arm (51, 52) in any position taken by said base 40, both along the linear guide 3 and about the vertical axis, under the action of the rotation system 42.

In a preferred, but merely illustrative and non-limiting, embodiment of stabilization manipulator 2 according to the present invention, each arm (51, 52) comprises a respective rotation device 7. Said rotation device 7 is adapted to cause the corresponding roller (512, 522) to rotate, preferably to oscillate, about a horizontal axis by approximately 90°, e.g. from 0° to 100°, preferably from 0° to 90°, relative to the corresponding arm (51, 52). More in general, each roller (512, 522) is adapted to rotate idly about its own longitudinal axis. In particular, the longitudinal axis of each roller (512, 522) is different and distinct from the axis about which it is made to rotate by the respective rotation device 7.

Each roller (512, 522) comprises a fixed part adapted to be constrained to the corresponding arm (51, 52) and a movable part adapted to rotate idly.

Each roller (512, 522) is adapted to assume a configuration in which it is substantially parallel to the longitudinal axis of the corresponding arm (51, 52), i.e. forming an angle of 0° with the longitudinal axis of the corresponding arm (512, 522), and a configuration in which it is substantially perpendicular to the longitudinal axis of the arm (51, 52) associated therewith, i.e. forming an angle of approximately 90° with the longitudinal axis of the corresponding arm (51, 52). Thus, each roller (512, 522) can change its own position to vary the possible interaction with a drilling element "P" in order to cooperate in the manipulation system in handling such drilling element "P".

In a preferred, but merely illustrative and non-limiting, embodiment of manipulator 2 according to the present invention, said first arm 51 has a greater longitudinal extension than said second arm 52. This solution makes it possible to act upon a drilling element "P" in two different locations along the longitudinal extension of said drilling element "P", thus improving stability and reducing any oscillatory motion of said drilling element "P" during the handling thereof.

Preferably, in order to act evenly upon drilling elements "P", roller 512 associated with said first arm 51 and roller 522 associated with the second arm 52 are substantially equal.

In one possible, but merely illustrative and non-limiting, embodiment, each rotation device 7 is a linear actuator, preferably a hydraulic one, adapted to act upon said movable part of the corresponding roller (512, 522) for the purpose of assuming the different operating configurations required.

In a preferred, but merely illustrative and non-limiting, embodiment of manipulator 2 according to the present invention, said carriage 4 comprises an actuator 32 adapted to cause the sliding blocks, preferably equipped with rollers, to slide along said linear guide 3.

In a preferred, by merely illustrative and non-limiting, embodiment, said linear guide 3 is a pair of rails.

In one possible embodiment, said actuator 32 comprises an electric motor and a kinematic mechanism, e.g. a rack, which drive the sliding blocks of carriage 4 along said linear guide 3.

Preferably, said linear guide 3 is positioned along the direction that joins the well centre "H" and the secondary well "M".

Preferably, the longitudinal extension of said linear guide 3 corresponds to the depth of fingerboard 14 of drilling rig 1. More preferably, such linear guide 3 substantially matches the projection on drill floor 13 of the central corridor between housings 142 comprised in fingerboard 14, e.g. corresponding to the extension of that region of drill floor 13, also known as setback, which is intended to house the drilling elements "P" or stands "S". Even more preferably, said linear guide 3 is adapted to be placed in a position corresponding to that portion of drill floor 13 whereon lifting device or catwalk 16 deposits or picks up a drilling element "P".

Preferably, linear guide 3 comprises guiding elements for suitably arranging the cables and/or hoses of stabilization manipulator 2, so that it can travel along linear guide 3.

In a preferred, but merely illustrative and non-limiting, embodiment of stabilization manipulator 2 according to the present invention, the actuators (32, 42, 6) respectively adapted to drive carriage 4, base 40 and the arms (51, 52) are electric actuators. Such a solution ensures precise, simple and quick control over the positioning of carriage 4 and the arms (51, 52), for the purpose of properly coordinating the movements thereof within the manipulation system.

Preferably, said rotation devices 7, each one adapted to rotate the corresponding roller (512, 522), are of the hydraulic type. With this solution, motion is obtained through the use of a compact, small actuator.

More in general, each actuator (32, 42, 6, 7) can be operated independently of the other actuators.

Preferably, stabilization manipulator 2 according to the present invention further comprises a control system 22. Said control system 22 is adapted to independently control all the actuators, in particular the electric actuators, comprised in said carriage 4 and in said arms (51, 52). This solution allows stabilization manipulator 2 to be precisely controlled to properly coordinate it with a multifunction manipulator 8, thus ensuring optimal operability and accuracy over all the degrees of freedom of said stabilization manipulator 2.

In a preferred embodiment of stabilization manipulator 2 according to the present invention, it is so designed that each roller (512, 522), located at the distal end of the corresponding arm (51, 52), can be moved with at least four degrees of freedom.

In a preferred, but merely illustrative and non-limiting, embodiment, said stabilization manipulator 2 comprises a plurality of sensors 33. Said sensors 33 and the actuators comprised in stabilization manipulator 2 are electrically connected to and monitored and/or controlled by control system 22 of stabilization manipulator 2. Said control system 22 is adapted to efficiently cooperate within the control architecture of drilling rig 1 and with a manipulation system, comprising a multifunction manipulator 8, for handling one or more drilling elements "P" in the different operating configurations of drilling rig 1. Preferably, said control system 22 is electronically connected to a control unit 10 comprised in drilling rig 1, for the purpose of using stabilization manipulator 2, in cooperation with a multifunction manipulator 8, as required during the different operating phases of drilling rig 1.

Said sensors 33 of stabilization manipulator 2 may be position sensors, limit switches and/or rotation sensors useful for determining, as accurately as possible, the position of carriage 4, of the arms (51, 52) and of the rollers (512, 522). In one possible embodiment, said sensors 33 may be force sensors, useful for determining the action exerted by the rollers (512, 522) upon drilling elements "P", and/or optical sensors and/or inductive sensors useful for determining the position of the arms (51, 52) and of the rollers (512, 522) with respect to drilling elements "P". The construction details of individual sensors 33 will not be described herein any further, since they are per se known to a person skilled in the art.

Said stabilization manipulator 2 is particularly suitable for being included in an assembly, in particular a manipulation system. Said manipulation system is particularly suitable for manipulating, in particular moving, drilling elements "P". Said manipulation system is particularly suitable for being included in a drilling rig 1, particularly in drilling rigs 1 in the absence of human operators, at least on a drill floor 13 and/or on a fingerboard 14 of said drilling rig 1.

Said manipulation system comprises, in addition to stabilization manipulator 2, a multifunction manipulator 8. Said multifunction manipulator 8 is adapted to handle drilling elements "P" in a drilling rig 1 for assembling, disassembling and moving a stand "S" of drilling elements "P". Said multifunction manipulator 8 is adapted to slide, in particular along rails 121 provided on a mast 12 comprised in drilling rig 1, vertically along a first axis "Z" parallel to the longitudinal extension of mast 12, and in particular perpendicular to said drill floor 13 whereon linear guide 3 of stabilization manipulator 2 is located.

More in detail, said multifunction manipulator 8 is adapted to grasp, hold and suitably release a first end of at least one drilling element "P" or of a stand "S" of drilling elements "P"; whereas said stabilization manipulator 2 is adapted to grasp and suitably release a second end of the same at least one drilling element "P" or of the same stand "S" of drilling elements "P". Said stabilization manipulator 2 is not adapted to hold the drilling elements "P", as previously specified, so as to not create a hyperstatic system for moving and handling drilling elements "P". As a matter of fact, stabilization manipulator 2 catches drilling element "P" between said rollers (512, 522) for the purpose of accompanying drilling element "P, not for holding it.

In a preferred embodiment of the manipulation system according to the present invention, it comprises a control unit 10 adapted to at least control the relative motion of said stabilization manipulator 2 and said multifunction manipulator 8 so as to obtain mutually coordinated movements. Preferably, said control unit 10 is the control unit of drilling rig 1. In particular, said control system 22 of stabilization manipulator 2 is adapted to communicate with said control unit 10 of drilling rig 1. Preferably, also a control unit of multifunction manipulator 8 is adapted to communicate with control unit 10 of drilling rig 1.

In a preferred embodiment of the manipulation system according to the present invention, said multifunction manipulator 8 comprises a slide 82, adapted to slide along rails 121 disposed along the longitudinal extension of mast 12; an articulated arm 83; a robotic apparatus 84; a manipulation head 85. More in detail, said robotic apparatus 84 *id* adapted to move said manipulation head 85 with at least three degrees of freedom. More in general, said multifunction manipulator 8 is configured to move said manipulation head 85 with at least five degrees of freedom. One possible embodiment of said multifunction manipulator 8 is described in prior document WO2019207493 by Drillmec Inc., the contents of which can be considered as comprised and incorporated in the contents of the present patent application.

Said stabilization manipulator 2 and/or the manipulation system according to the present invention are particularly suitable for being comprised in a drilling rig 1.

Drilling rig 1 according to the present invention comprises a substructure adapted to be set at ground level where drilling will take place. Said drilling rig 1 according to the present invention further comprises a mast 12, which extends along a vertical axis parallel to said vertical first axis "Z". Said drilling rig 1 comprises a drill floor 13 set at a predefined height above the ground, on top of the substructure.

Drilling rig 1 further comprises a drill head 15, which is adapted to slide along said mast 12.

Mast 12 comprises, at a predefined height above drill floor 13, a fingerboard 14. In said fingerboard 14, a plurality of drilling elements "P", preferably in the form of stands "S" of drilling elements "P", can be housed. Said fingerboard 14 is adapted to suitably group said drilling elements "P", preferably assembled together as stands "S".

Drilling rig 1 according to the present invention comprises also a lifting device or catwalk 16. Said lifting device 16 is adapted to move drilling elements "P" from the ground level to drill floor 13, and vice versa.

Drilling rig 1 according to the present invention comprises at least one stabilization manipulator 2 and/or one manipulation system according to the present invention.

Drilling rig 1 according to the present invention advantageously comprises highly automated systems and circuits. The high level of automation of drilling rig 1 according to the present invention permits reducing the number of human operators required in the rig, particularly on drill floor 13 and/or on fingerboard 14. Said highly automated systems and circuits are, for example, systems for continuous mud circulation and systems for connecting the rig to the drill pipes when adding or removing drill pipes.

Preferably, said control unit 10 provides automated control over drill head 15 and lifting device 16, as well as other systems included in drilling rig 1.

The manipulation system according to the present invention is particularly suitable for implementing at least one method of assembling drilling elements "P" in order to make a stand "S" of drilling elements "P".

In particular, the manipulation system according to the present invention is particularly suitable for executing the steps of methods of assembling, disassembling and moving one or more drilling elements "P".

The method of assembling according to the present invention comprises the following steps, preferably carried out in succession:

a) grasping a drilling element "P", placed on a drill floor 13 by said lifting device 16;
b) lifting the drilling element "P" along a vertical axis "Z";
c) positioning the drilling element "P" in a vertical position relative to said drill floor 13;
d) moving said drilling element "P" towards a secondary well or mousehole "M";
e) inserting said drilling element "P" into said secondary well "M", while retaining it therein;
f) repeating steps a) to d) to handle another drilling element "P";
g) placing the drilling elements "P" in abutment with each other and fastening them together;
h) inserting the assembly of drilling elements "P" into said secondary well "M", while retaining it therein;
i) repeating steps f) to h) to assemble another drilling element "P".

This sequence of steps permits creating a stand "S" of drilling elements "P" comprising at least three drilling elements "P", which are preferably all equal. In fact, it is possible to repeat the steps from f) to i) in order to connect the desired number of drilling elements "P".

By executing the above-described steps of the present method in reverse order, it will be possible to disassemble a plurality of drilling elements "P", e.g. a stand "S".

Figure 8A:
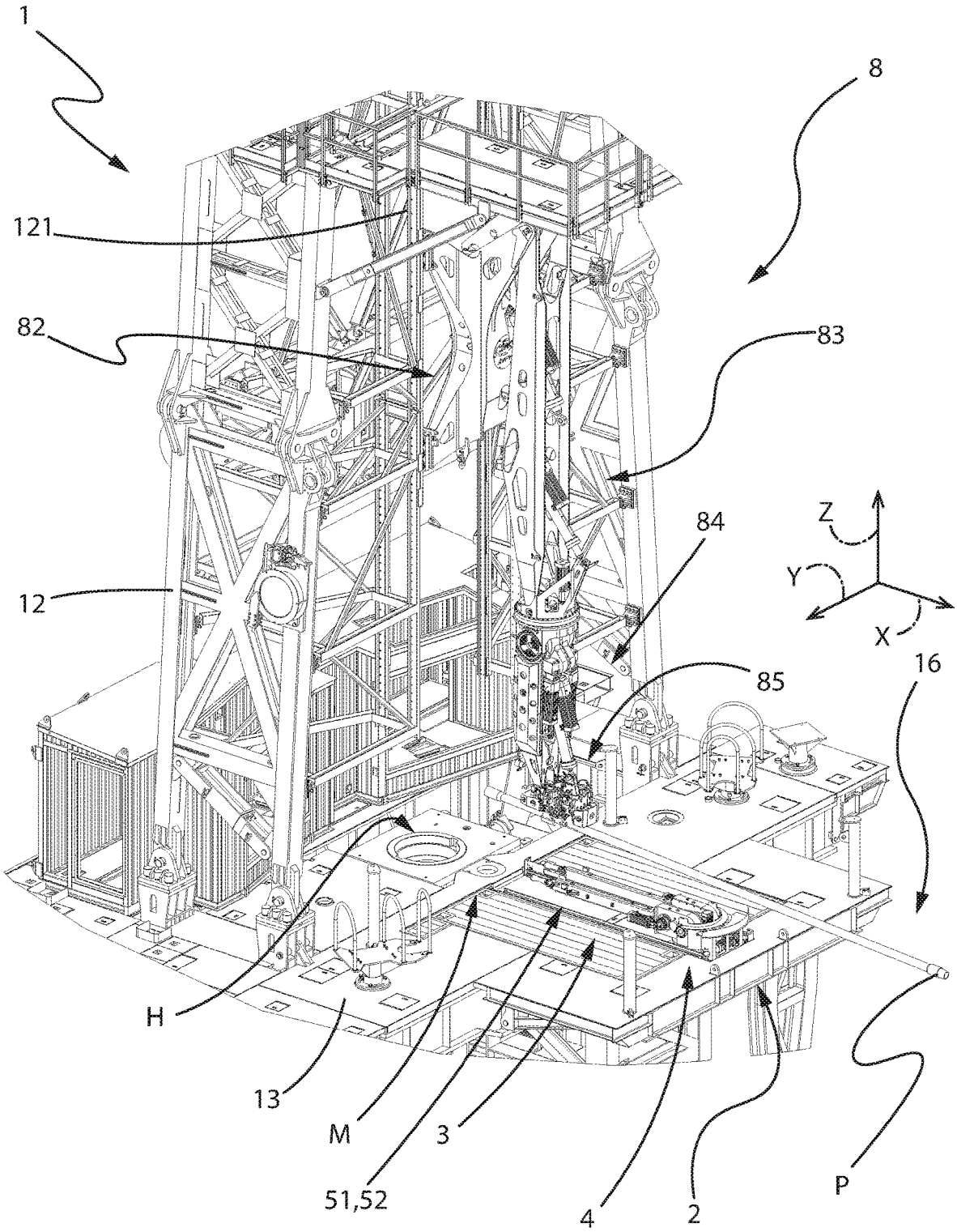
FIGS. 8A, 8B, 8C and 8D show some details of a drilling rig comprising a manipulation system, which in turn comprises a multifunction manipulator and a stabilization manipulator, in different operating phases of the manipulation system; in particular.

The steps of the present method, according to the present invention, are carried out by means of a multifunction manipulator 8 that cooperates with a stabilization manipulator 2 according to the present invention. The step of grasping a drilling element "P", carried out by multifunction manipulator 8, permits grasping drilling element "P", preferably one end of drilling element "P", in a firm and safe manner. FIG. 8A shows, for example, multifunction manipulator 8 grasping one end of drilling element "P" that has been placed in proximity to drill floor 13 by a lifting device 16. This step allows drilling element "P", which has been placed on drill floor 13 and lies thereon substantially horizontal, to be automatically grasped without requiring human intervention.

The step of lifting drilling element "P" along a vertical axis "Z", carried out by means of multifunction manipulator 8 of the manipulation system according to the present invention, makes it possible to safely lift drilling element "P" while reducing the load on said multifunction manipulator 8. During this step, stabilization manipulator 2 cooperates by allowing drilling element "P" to slide on at least one roller (512, 522), so that no oscillatory motion and/or slipping will be generated which may apply undesired forces or loads on said multifunction manipulator 8 and/or on stand "S". In particular, at least one roller (512, 522) is set substantially perpendicular to the corresponding arm (51, 52), and the corresponding arm (51, 52) is rotated by said handling device 6 in order to support, at least partly, drilling element "P", thus cooperating with multifunction manipulator 8 to move said drilling element "P" into a vertical position. Preferably, during this step only one arm is raised, preferably said first arm 51, and the corresponding roller 512 is set perpendicular to said arm by rotation device 7.

The step of positioning drilling element "P" in a vertical position by means of the manipulation system, according to the present invention, is carried out in such a way as to reduce as much as possible the onset of sussultatory or vibratory movements of drilling element "P". This solution reduces the risk of accidents on drill floor 13.

The step of moving said drilling element "P" towards a secondary well "M" envisages the use of the same multifunction manipulator 8 to easily, quickly and safely set drilling element "P" near the secondary well "M". During this step, stabilization manipulator 2 moves both arms (51, 52) in such a way that, by activating the respective rotation devices 7, both rollers (512, 522) will be set in a configuration perpendicular to the respective arm (51, 52), so that drilling element "P" will position itself between the two rollers (512, 522). In this configuration, any oscillatory motion of drilling element "P" is considerably damped. Moreover, since there is no constraint between the rollers (512, 522) and drilling element "P", this is not a hyperstatic system, and therefore it is not necessary to ensure a perfect synchronization of the movements of multifunction manipulator 8 and of stabilization manipulator 2, while preventing drilling element "P", as well as the manipulators (2, 8) themselves, from being subject to torque forces generated by the action of both manipulators (2, 8). Stabilization manipulator 2 will accompany the movement of drilling element "P" being conducted by multifunction manipulator 8.

Figure 8B:
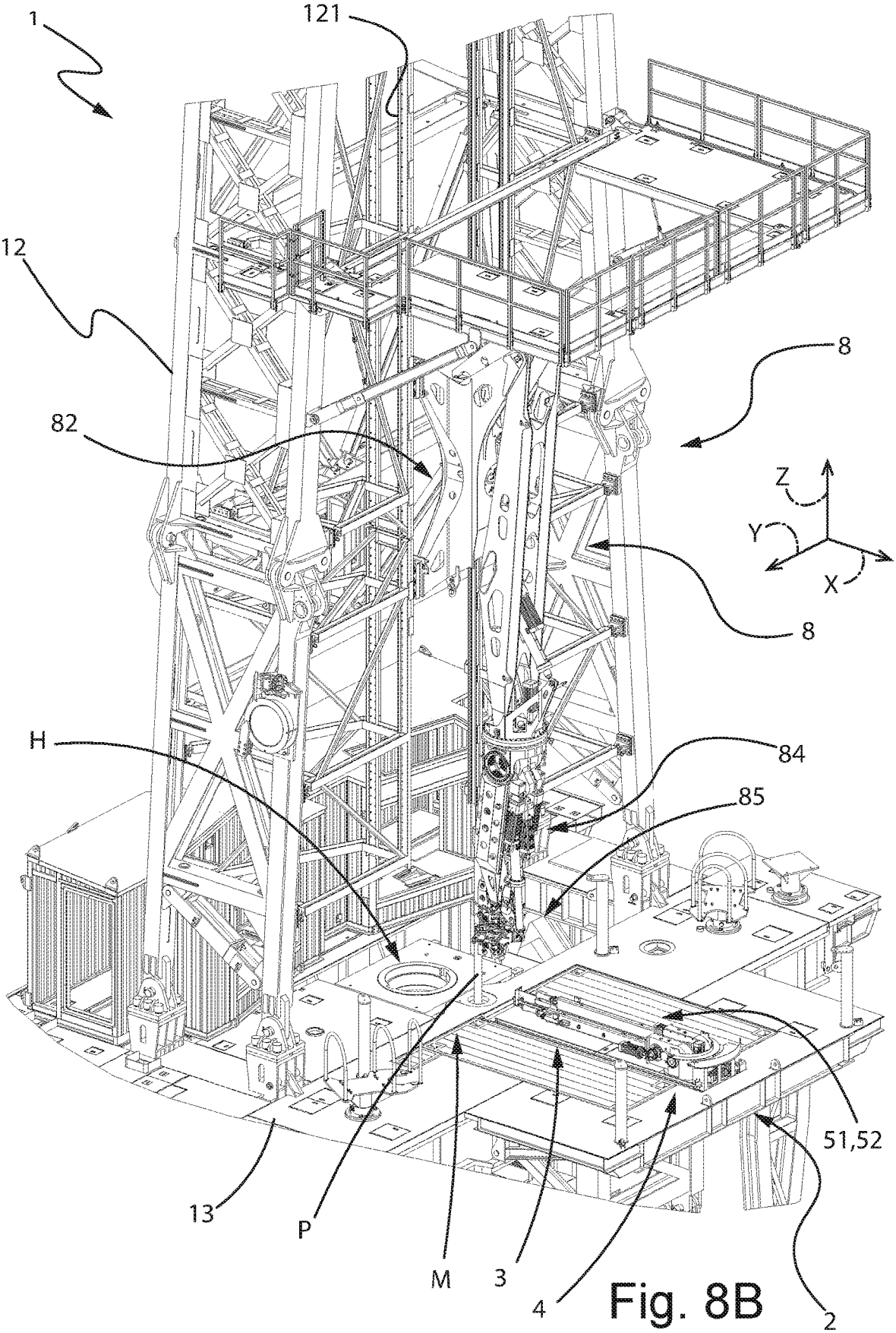

The step of inserting said drilling element "P" into said secondary well "M" while retaining it therein envisages that, once drilling element "P" has been inserted in said secondary well "M" by multifunction manipulator 8, at least one retaining device, already included in drilling rig 1, will retain drilling element "P" so that it will remain at a predefined height inside the secondary well "M". FIG. 8B shows the positioning of a first drilling element "P" inside the secondary well "M" by means of said multifunction manipulator 8. Preferably, drilling element "P" is firmly held by a clamp located inside the secondary well "M", which prevents drilling element "P" from falling into the secondary well "M". As visible in the figure, stabilization manipulator 2 is no longer necessary and assumes a configuration causing less hindrance.

Once the first drilling element "P" has been placed inside the secondary well "M", multifunction manipulator 8 will release drilling element "P" and the manipulation system according to the present invention will carry out the same steps already described, particularly the steps from step a) to step d) of the method according to the present invention, in order to handle another drilling element "P", in particular a second drilling element "P".

After the second drilling element "P" has been vertically aligned with the secondary well "M", the step of positioning drilling elements "P" in abutment with each other and fastening them is carried out. During this step, the two drilling elements "P" are fastened to each other by means of a connection system, e.g. a power tong comprised in drill floor 13. In this manner, the torque required to ensure proper tightening is applied to the two drilling elements "P". Multifunction manipulator 8, in particular said manipulation head 85, allows for controlled rotation of the second drilling element "P" without however releasing it, so that it can be coupled and fastened to the first drilling element "P".

When the step of positioning drilling elements "P" in abutment with each other is complete, the step of inserting such assembled drilling elements "P" into said secondary well "M" while retaining them therein is carried out. During this step, the assembly of drilling elements "P" is inserted, by means of multifunction manipulator 8, into the secondary well "M" down to an adequate depth. When the assembly has reached the optimal depth, the assembly of drilling elements "P" is retained by the clamp located inside the secondary well "M", thus preventing the assembly of drilling elements "P" from falling any further into the secondary well "M". In one possible embodiment, the system that retains drilling elements "P" in the secondary well "M" is the same system that is capable of mutually fastening drilling elements "P".

Preferably, once the assembly of drilling elements "P" has been placed inside the secondary well "M", multifunction manipulator 8 will release the assembly and the manipulation system according to the present invention will carry out the same steps already described, particularly the steps from step f) to step h) of the method according to the present invention, in order to handle another drilling element "P", in particular a third drilling element "P".

The handling of the third drilling element "P" is carried out by the manipulation system according to the present invention in the same way as described with reference to the first and second drilling elements "P"; the third drilling element "P" is then appropriately fastened to the assembly of the first and second drilling elements "P". More in general, the present sequence of steps permits assembling together at least three drilling elements "P", in order to obtain a stand "S" of at least three drilling elements "P", in a simple and quick manner, with the utmost safety.

The manipulation system according to the present invention is particularly suitable for implementing a method of moving drilling elements "P" from a well (H, M), e.g. a secondary well or mousehole "M", to a fingerboard 14 of a drilling rig 1.

The method of moving according to the present invention comprises the following steps, preferably carried out in succession:

- grasping, by means of a manipulation head 85 of multifunction manipulator 8, a drilling element "P" which is a part of a stand "S" of drilling elements "P" retained by at least one retaining element, e.g. a clamp, at said well (M, H);
- moving said stand "S" of drilling elements "P", in particular moving said stand "S" aside from said well (M, H) towards an area where it causes less hindrance;
- reversing the orientation of said manipulation head 85, by rotating said manipulation system about at least one axis, preferably a vertical axis;
- moving said stand "S" towards a suitable housing 142 comprised in fingerboard 14;
- lowering said stand "S";
- releasing said drilling element "P" of stand "S" into the suitable housing 142.

This sequence of steps permits moving a plurality of drilling elements "P", preferably in the form of a stand "S" of drilling elements "P", comprising, for example, three drilling elements "P", which are preferably all equal.

By executing the steps described in the present method in reverse order, it is possible to move at least one stand "S" of drilling elements "P" from fingerboard 14 towards at least one well (H, M).

The steps of the present method, according to the present invention, are carried out by means of a manipulation system comprising a multifunction manipulator 8 cooperating with a stabilization manipulator 2 according to the present invention.

The step of grasping a drilling element "P" by means of a manipulation head 85 is preferably carried out in order to pick up a stand "S" of drilling elements "P". Depending on the well type, e.g. main well or well centre "H" or the secondary well "M", drilling element "P" comprised in stand "S" is retained by one or more mutually independent clamps. Said clamps may be either directly comprised in the well or associated with a device interacting with said well, such as drill head 15.

Figure 8C:
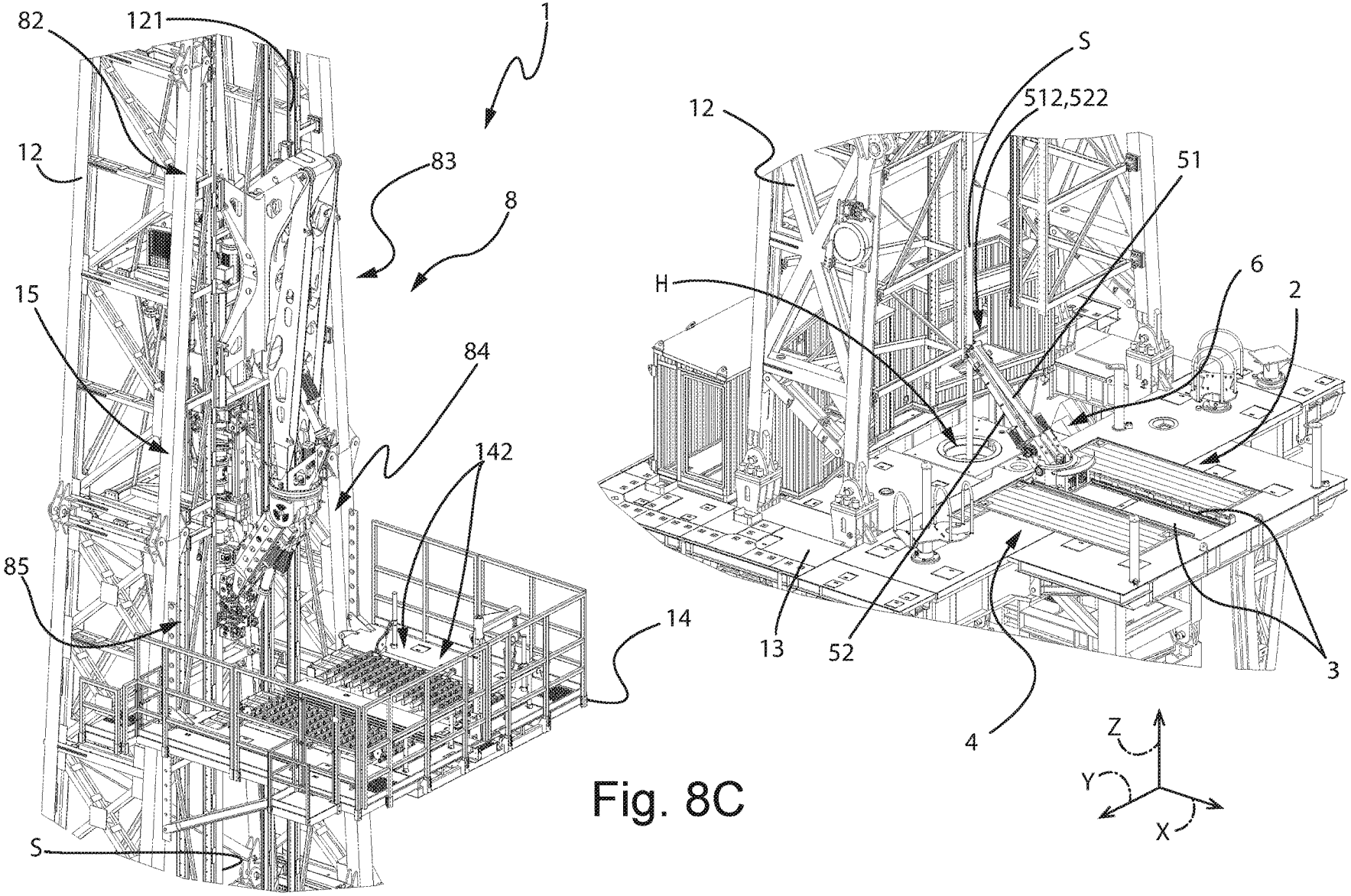

In a preferred, but non-limiting, embodiment like the one shown by way of example in FIG. 8C, multifunction manipulator 8 lifts stand "S" of drilling elements "P" from well centre "H", so that it can be moved into a housing 142 in fingerboard 14 of drilling rig 1. Said stabilization manipulator 2 cooperates in moving stand "S". As shown in the drawing, both arms (51, 52) of the stabilization manipulator are moved in such a way that drilling element "P" will position itself between the two rollers (512, 522).

This configuration can be obtained by appropriately activating rotation devices 7 of both rollers (512, 522) and handling device 6. In this configuration of stabilization manipulator 2, any oscillatory motion of drilling element "P" is considerably damped. Moreover, since there is no constraint between the rollers (512, 522) and drilling element "P", this is not a hyperstatic system, and drilling element "P" and the manipulators (8, 2) are not subject to torque forces resulting from the action of both manipulators (2, 8). Stabilization manipulator 2 will accompany the movement of drilling element "P" as it is conducted by multifunction manipulator 8.

Said fingerboard 14 is located at a predefined height of mast 12 above drill floor 13. Said fingerboard 14 is designed to comprise a plurality of housings 142, preferably arranged in a rack fashion, starting from a minimum distance from mast 12.

In general, the lifting of stand "S" by means of multifunction manipulator 8 occurs in line with the axis of a well (M, H), depending on the current operating phase of drilling rig 1.

The step of moving said stand "S" aside from said well (M, H) towards an area where it causes less hindrance envisages, in the preferred embodiment, to move stand "S" along the second axis "X" by means of multifunction manipulator 8, which cooperates with stabilization manipulator 2. During this phase, stabilization manipulator 2 accompanies the movement of drilling element "P" as it is conducted by multifunction manipulator 8, keeping said drilling element "P" between the rollers (512, 522) of both arms (51, 52). This configuration allows drilling element "P" to slide along its longitudinal extension.

Preferably, said area of less hindrance is an area in front of mast 12, between mast 12 itself and the area where housings 142 of fingerboard 14 are located. Due to the characteristics of multifunction manipulator 8 according to the present invention, such area can be quite small.

As visible in FIG. 8C, the first end or extremity of stand "S" of drilling elements is held by multifunction manipulator 8 by means of said manipulation head 85, while the second extremity is caught between the two arms (51, 52) of stabilization manipulator 2, in particular being arranged between the two rollers (512, 522).

Subsequently, the method envisages a step of reversing the orientation of said manipulation head 85. In the preferred embodiment, said robotic apparatus 84 of multifunction manipulator 8 is adapted to rotate about an axis parallel to said vertical axis "Z", thereby causing manipulation head 85 to rotate as well. In this manner, multifunction manipulator 8 can place a stand "S" into the optimal position for inserting it into fingerboard 14, even when the room available for this manoeuvre is limited. Preferably, as multifunction manipulator 8 rotates, also stabilization manipulator 2 is rotated by turning said base 40. Preferably, said base 40 is in line with said multifunction manipulator 8, turning about the same axis.

In an exemplary, but non-limiting, embodiment, the reversal of the orientation of manipulation head 85 of multifunction manipulator 8 is such as to put multifunction manipulator 8 in the best configuration that allows an easy positioning of drilling element "P" inside fingerboard 14. During the handling of stand "S" by multifunction manipulator 8, said stabilization manipulator 2 continues to accompany stand "S", cooperating with said multifunction manipulator 8.

Subsequently, the method envisages a step of moving said stand "S" of drilling elements "P" towards a suitable housing 142 comprised in fingerboard 14. During this step, it is necessary to move multifunction manipulator 8 to reach the corresponding suitable housing 142, comprised in fingerboard 14. During this step, it is possible to change the distance along said second axis "X" by means of said articulated arm 83 and/or the distance from a third axis "Y" by means of robotic apparatus 84, as well as to turn about an axis parallel to said axis "Z". In particular, it is possible to suitably activate one or more electric actuators comprised in robotic apparatus 84 to reach any housing 142 of fingerboard 14, said housings 142 lying in a horizontal plane defined by the second axis "X" and third axis "Y".

Preferably, said stabilization manipulator 2 cooperates in moving stand "S" by following in a coordinated manner the movements made by multifunction manipulator 8. In particular, carriage 4 can be made to slide, by means of said actuator 32, along said linear guide 3, which is aligned with said second axis "X". Furthermore, via rotation system 42, handling device 6 and rotation device 7, said stabilization manipulator 2 can accompany a stand "S" until it reaches any housing 142 of fingerboard 14, said housings 142 lying in the plane defined by said second axis "X" and third axis "Y".

Figure 8D:
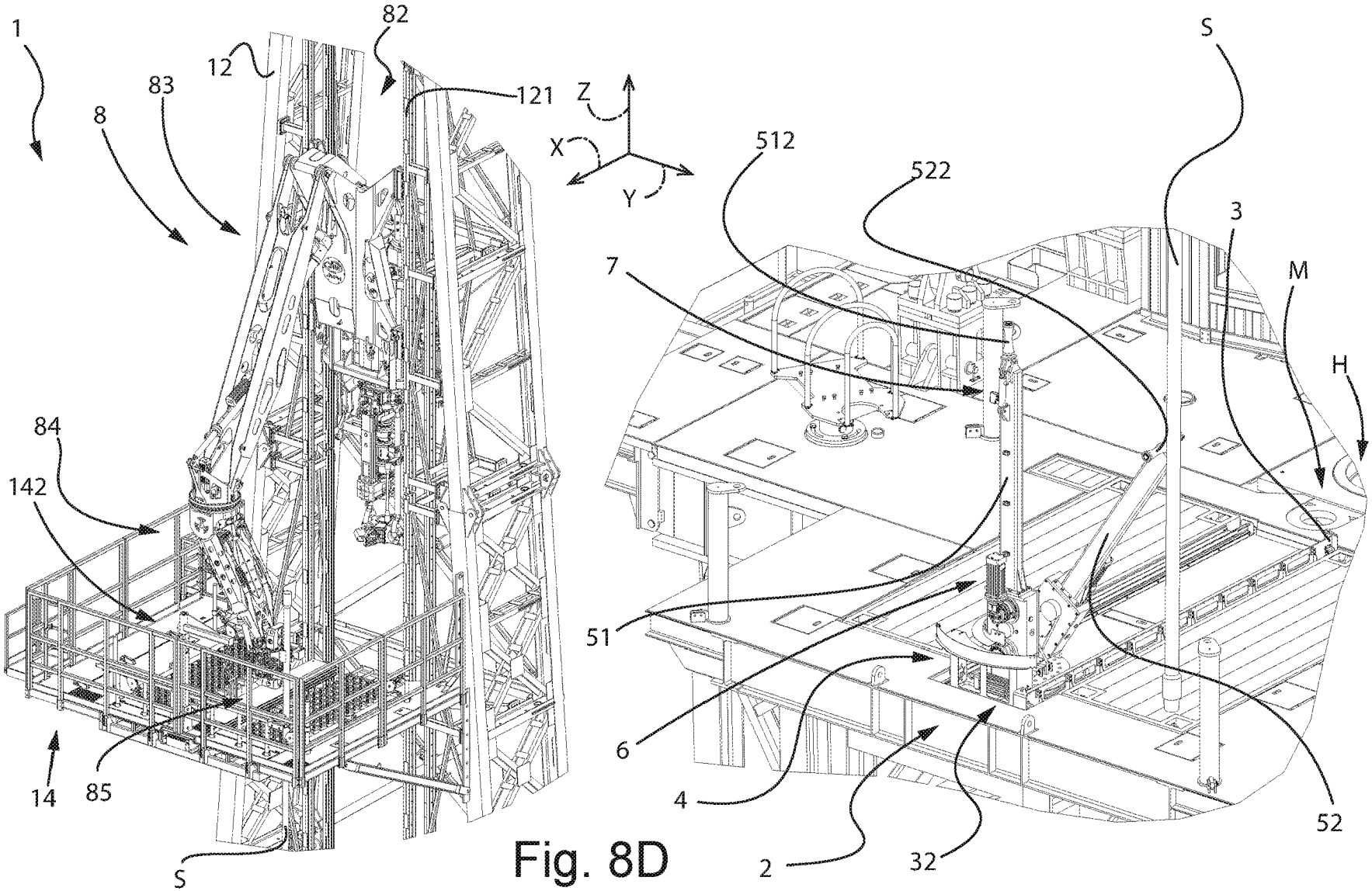

In the exemplary, but non-limiting, embodiment shown in FIG. 8D, stand "S" of drilling elements "P" is moved, by the manipulation system according to the present invention, to a suitable housing 142 comprised in fingerboard 14.

In this figure one can see that said manipulation system can reach any housing 142 of fingerboard 14 in a simple and quick manner. Moreover, the same figure shows how stabilization manipulator 2 cooperates with multifunction manipulator 8, thus creating a manipulation system capable of guiding stand "S" of drilling elements "P". The figure shows an arm (51, 52), in particular the first arm 51, guiding and pushing stand "S" into the suitable housing 142, in cooperation with multifunction manipulator 8 that handles stand "S".

Subsequently, the method envisages a step of lowering said stand "S". During this step it is possible to, by means of multifunction manipulator 8, place stand "S" into the appropriate position inside housing 142, so that it can be suitably grouped and/or stored for further use by a drilling rig 1.

The method according to the present invention then envisages a step of releasing said drilling element "P" of stand "S" into the suitable housing 142. Preferably, stand "S" of drilling elements "P", once it has been properly placed into housing 142, is released by multifunction manipulator 8, which can then be used to perform other tasks in drilling rig 1. Likewise, stabilization manipulator 2 is moved for reuse or to be stored in an area and/or configuration causing less hindrance.

Stand "S" of drilling elements "P" placed in housing 142 of fingerboard 14 can be subsequently retrieved, e.g. by the same manipulation system, to be used in the drilling procedure being executed by drilling rig 1 and/or for disassembling it into a plurality of drilling elements "P".

Furthermore, the manipulation system according to the present invention is particularly suitable for implementing a method of moving a stand "S" of drilling elements "P" from a fingerboard 14 towards a well (M, H), preferably a main well or well centre "H" of a drilling rig 1. The method of moving stands "S" of drilling elements "P" from a fingerboard 14 towards a well (M, H) according to the present invention comprises the following steps, preferably carried out in succession:

i. grasping, by means of a manipulation head 85 of multifunction manipulator 8, a drilling element "P"

comprised in a stand "S" located in a suitable housing 142 comprised in fingerboard 14;

ii. lifting said stand "S" of drilling elements "P";

iii. moving said stand "S" towards an area where it causes less hindrance to the rest of drilling rig 1;

iv. reversing the orientation of said manipulation head 85, by rotating at least a part of multifunction manipulator 8 about at least one axis;

v. moving said stand "S" into alignment with said well (M, H);

vi. releasing stand "S" of drilling elements "P", which is retained by at least one retaining element, e.g. a clamp, in said well (M, H).

This sequence of steps permits moving a plurality of drilling elements "P" in the form of a stand "S" comprising, for example, three drilling elements "P", which are preferably all equal.

The steps of the present method, according to the present invention, are carried out by means of the manipulation system according to the present invention.

The step of grasping, by means of a manipulation head 85, is executed by multifunction manipulator 8, which, thanks to its degrees of freedom, can reach any stand "S" housed in any housing 142 of fingerboard 14, being able to grasp it by means of said manipulation head 85.

At this stage, preferably, stabilization manipulator 2 is not yet cooperating with stand "S", but can be moved near stand "S" that has been grasped by manipulation head 85.

Subsequently, a step of lifting said stand "S" is carried out. Said multifunction manipulator 8, after having grasped drilling element "P", can lift stand "S", e.g. by making a movement along said axis "Z".

Preferably, stabilization manipulator 2 starts cooperating by moving the arms (51, 52) and the rollers (512, 522) in such a way that at least one roller is behind stand "S" to guide it out of housing 142 of the fingerboard and/or that the extremity of stand "S" which is opposite to the one grasped by manipulation head 85 is caught between the two rollers, as a function of stand "S" that has been grasped by multifunction manipulator 8.

The method then envisages a step of moving said stand "S" towards an area where it causes less hindrance to the rest of drilling rig 1, preferably the aforesaid area of less hindrance. In the preferred embodiment, stand "S" of drilling elements "P" is moved to an area of less hindrance by said multifunction manipulator 8, in cooperation with said stabilization manipulator 2. Thus, multifunction manipulator 8 guides the movement of stand "S" of drilling elements "P" from housing 142 towards an area where further handling can occur, such stand "S" being guided by stabilization manipulator 2.

Preferably, stabilization manipulator 2 does not hold stand "S", so as to avoid creating a hyperstatic system.

Subsequently, the method envisages a step of reversing the orientation of said manipulation head 85 by turning at least a part of multifunction manipulator 8 about an axis, preferably a vertical axis. Preferably, as multifunction manipulator 8 rotates, stabilization manipulator 2 is rotated as well by turning said base 40. Preferably, said base 40 is in line with said multifunction manipulator 8 and rotates about the same axis.

Preferably, said stabilization manipulator 2 cooperates in moving stand "S" by following, in a coordinated manner, the movements made by multifunction manipulator 8. In particular, under the action of said actuator 32, carriage 4 can slide along said linear guide 3. Moreover, by means of rotation system 42, handling device 6 and rotation device 7, stabilization manipulator 2 according to the present invention can accompany a stand "S" towards a well (H, M) starting from any housing 142 of fingerboard 14. Thus, while taking up little room, it is possible to put the manipulation system in the best conditions for positioning the same stand "S" of drilling elements "P" ready for the next handling operations.

In general, the method envisages, after the above-described steps, the execution of a step of moving said stand "S" into alignment with said well (M, H). The handling of stand "S" of drilling elements "P" effected by said multifunction manipulator 8 in cooperation with stabilization manipulator 2, in order to set it in line with the axis of a well, preferably positioning it at well centre "H", makes it possible to position stand "S" in line with the well where such stand "S" of drilling elements "P" is. Said stabilization manipulator 2 cooperates with the multifunction manipulator 8 in correctly positioning said stand "S" in line with said well.

Subsequently, the method envisages a step of releasing drilling element "P". During this step, multifunction manipulator 8 and stabilization manipulator 2 the drilling element "P", since stand "S" is already retained by at least one clamp. Thus, stand "S" is delivered by the manipulation system, more specifically by the manipulators (2, 8), to another device comprised in drilling rig 1, e.g. drill head 15, permitting the use of the manipulation system for other tasks in drilling rig 1 and automating the operation of drilling rig 1 according to the present invention.

Control unit 22 of stabilization manipulator 2, and more generally control unit 10 of the manipulation system and/or of drilling rig 1, are adapted to control the execution of at least a part of the methods according to the present invention, e.g. in cooperation with each other, e.g. by coordinating the movements of multifunction manipulator 8 and of stabilization manipulator 2 comprised in the manipulation system according to the present invention.

FIG. 1A shows one possible embodiment of stabilization manipulator 2 according to the present invention, in particular with stabilization manipulator 2 in a first operating configuration. In this figure, stabilization manipulator 2 is shown in a perspective front view. Such first configuration allows stabilization manipulator 2 to assume the least space-demanding configuration, since the arms (51, 52) are parallel to rail-shaped linear guide 3. Furthermore, the projection of said arms (51, 52) does not protrude from said linear guide 3, since carriage 4 has been positioned by said actuator 32 at one end, in particular at the distal end away from the wells (H, M), when said stabilization manipulator 2 is on drill floor 13 of a drilling rig 1. In this figure one can see an illustrative embodiment of actuator 32 capable of driving the sliding blocks of carriage 4 along linear guide 3. In particular, the figure shows, at least partly, an electric motor adapted to drive a kinematic mechanism for causing the sliding blocks of carriage 4 to slide along linear guide 3. This figure also shows one possible embodiment of rotation system 42 capable of rotating base 40 to which the arms (51, 52) are constrained. In particular, it shows, at least partly, an electric motor adapted to drive a rack of a slewing ring for rotating base 40.

The same figure also shows one possible embodiment of handling device 6 for moving an arm about a horizontal axis. In particular, at least for the first arm 51, an electric motor is visible, which is adapted to drive a kinematic mechanism for rotating arm 51 relative to base 40 it is constrained to.

It is also possible to see one possible embodiment of rotation device 7 for moving the rollers relative to the arms.

In particular, at least for the first arm 51, a hydraulic linear actuator is visible, which is adapted to act upon roller 512.

The figure shows that the rollers (512, 522) have, along their longitudinal extension, a wedgelike conformation in their central portion.

Figure 1B:
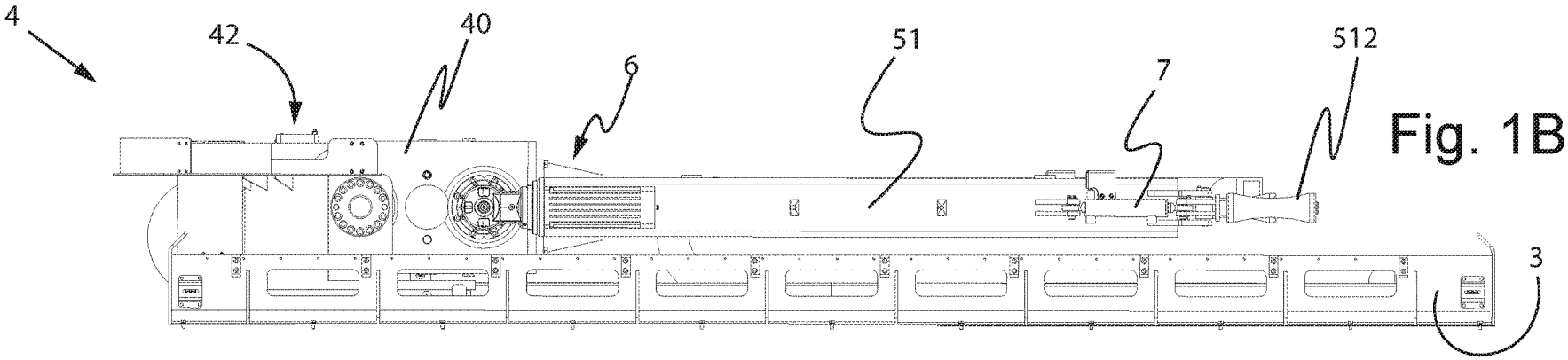

FIG. 1B shows a side view of the same stabilization manipulator 2 of FIG. 1A, in the same operating configuration. This figure clearly shows that handling devices 6 position their respective arms (51, 52) at 0° relative to linear guide 3, so that they are parallel to said linear guide 3. From this figure, it is also clear that, by means of rotation system 42 of carriage 4, base 40 is positioned in such a way as to align the arms (51, 52) with said linear guide 3.

From this figure, it can also be understood that in such a configuration the stabilization manipulator takes up the least room. The figure also shows some further details of one possible embodiment of carriage 4, base 40, the rotation system, the arms (51, 52), handling device 6, rotation device 7 and the rollers (512, 522).

FIGS. 2A, 2B and 2C show stabilization manipulator 2 of FIGS. 1A and 1B in different possible operating configurations.

In particular, FIG. 2A shows a plan view from above of stabilization manipulator 2 in a second operating configuration; whereas FIG. 2B shows a plan view from above of stabilization manipulator 2 in the first operating configuration.

As becomes immediately clear when comparing FIGS. 2A and 2B, rotation system 42 has been operated in order to change the position of base 40 of carriage 4, thereby causing the arms (51, 52) to rotate.

FIG. 2C shows a plan view from above of stabilization manipulator 2 in a third operating configuration. Likewise, comparing FIGS. 2B and 2C, rotation system 42 has been operated in order to change the position of base 40 of carriage 4, thereby causing the arms (51, 52) to rotate.

In FIGS. 2A-2C, only rotation system 42 has been actuated, e.g. by control system 22, in order to rotate base 40. The remaining actuators, e.g. actuator 32, handling devices 6 and rotation devices 7, have not been operated, leaving their configuration unchanged. In such figures one can also see some possible construction details of a preferred embodiment of stabilization manipulator 2.

Figure 3B:
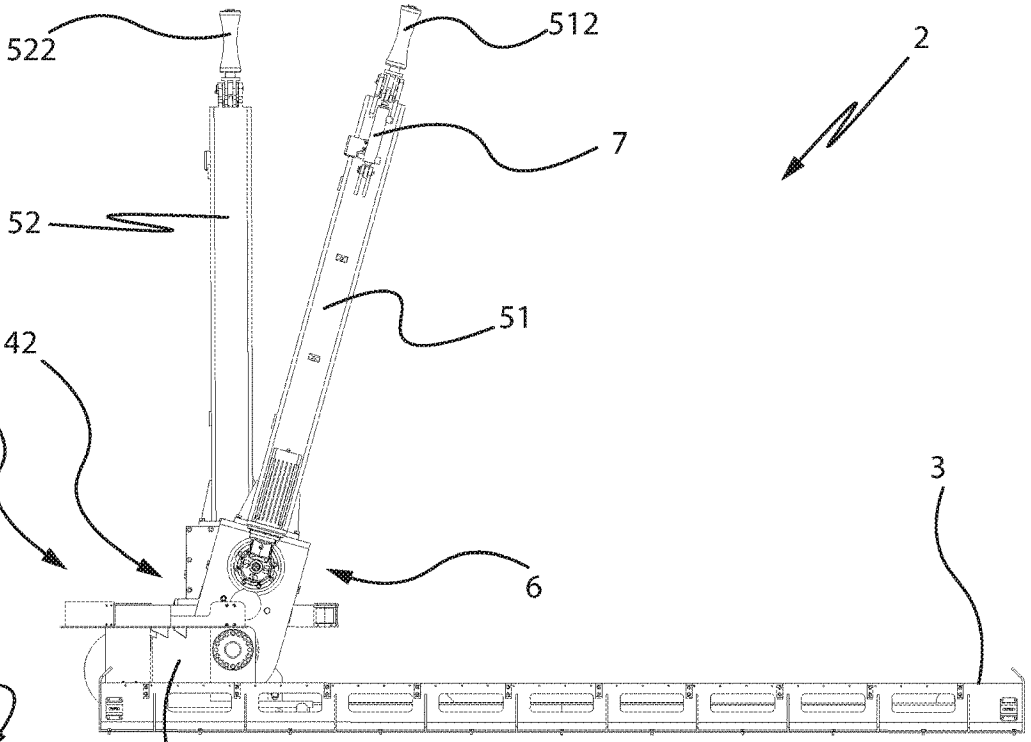
FIGS. 3A and 3B show the stabilization manipulator of FIG. 1A in a fourth operating configuration; in particular.
Figure 3A:
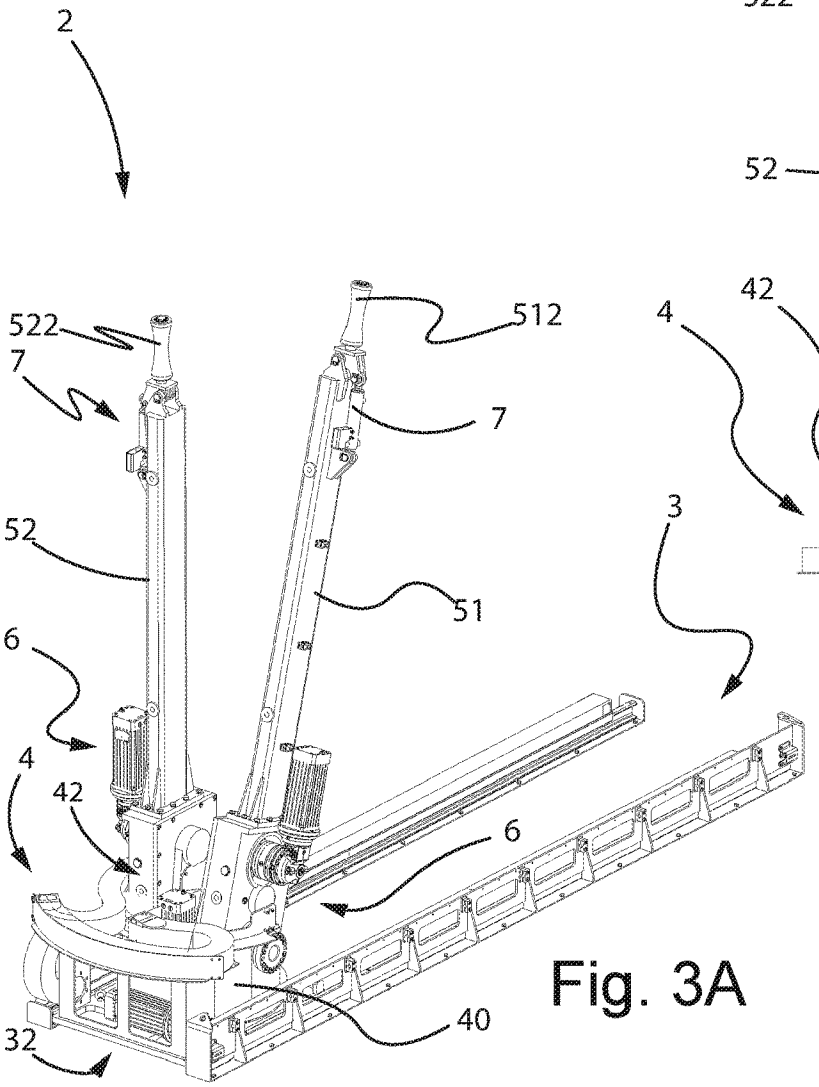

FIG. 3A shows a perspective front view of stabilization manipulator 2 of the preceding figures in a fourth operating configuration. As clearly visible when comparing FIGS. 1A and 3A, both handling devices 6 have been operated, e.g. by means of control system 22, in order to raise the arms (51, 52). More in particular, handling device 6 associated with the second arm 52 has been operated in order to position said second arm at a greater angle than the first arm 51, which is handled by the respective handling device 6.

FIG. 3B shows a side view of stabilization manipulator 2 in the fourth operating configuration. Comparing FIGS. 1B and 3B, one can see that both handling devices 6 have been operated, e.g. by means of control system 22, in order to raise the arms (51, 52), causing them to assume different angles relative to linear guide 3.

Comparing the fourth operating configuration with the first operating configuration, only handling devices 6 have been operated, e.g. by control system 22, in order to rotate the respective arms (51, 52) relative to base 40 they are constrained to. The remaining actuators, e.g. actuator 32, rotation system 42 and rotation devices 7, have not been operated, leaving their configuration unchanged.

Figure 4A:
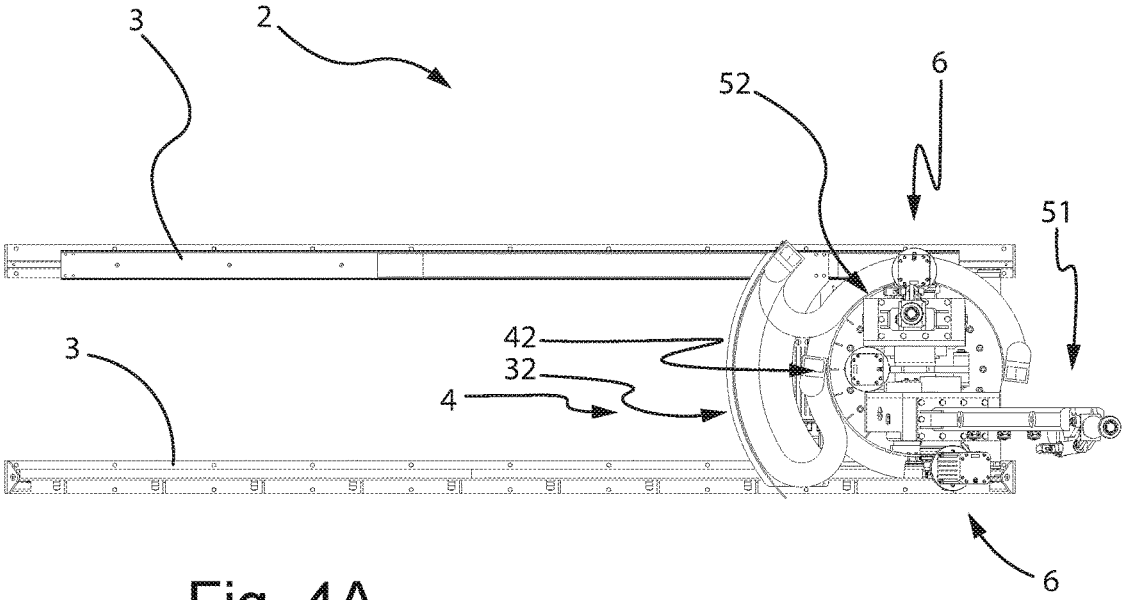
FIGS. 4A and 4B show the stabilization manipulator of FIG. 1A in a fifth operating configuration; in particular.

FIG. 4A shows a plan view from above of stabilization manipulator 2 of the preceding figures in a fifth operating configuration. As clearly visible when comparing FIGS. 3A and 4A, carriage 4 has been moved from one end, in particular the distal end, to the other end, in particular the proximal end, of linear guide 3 by means of said actuator 32. More in particular, actuator 32 has been operated by control system 22 in order to cause carriage 4 to slide along rail-shaped linear guide 3.

Figure 4B:
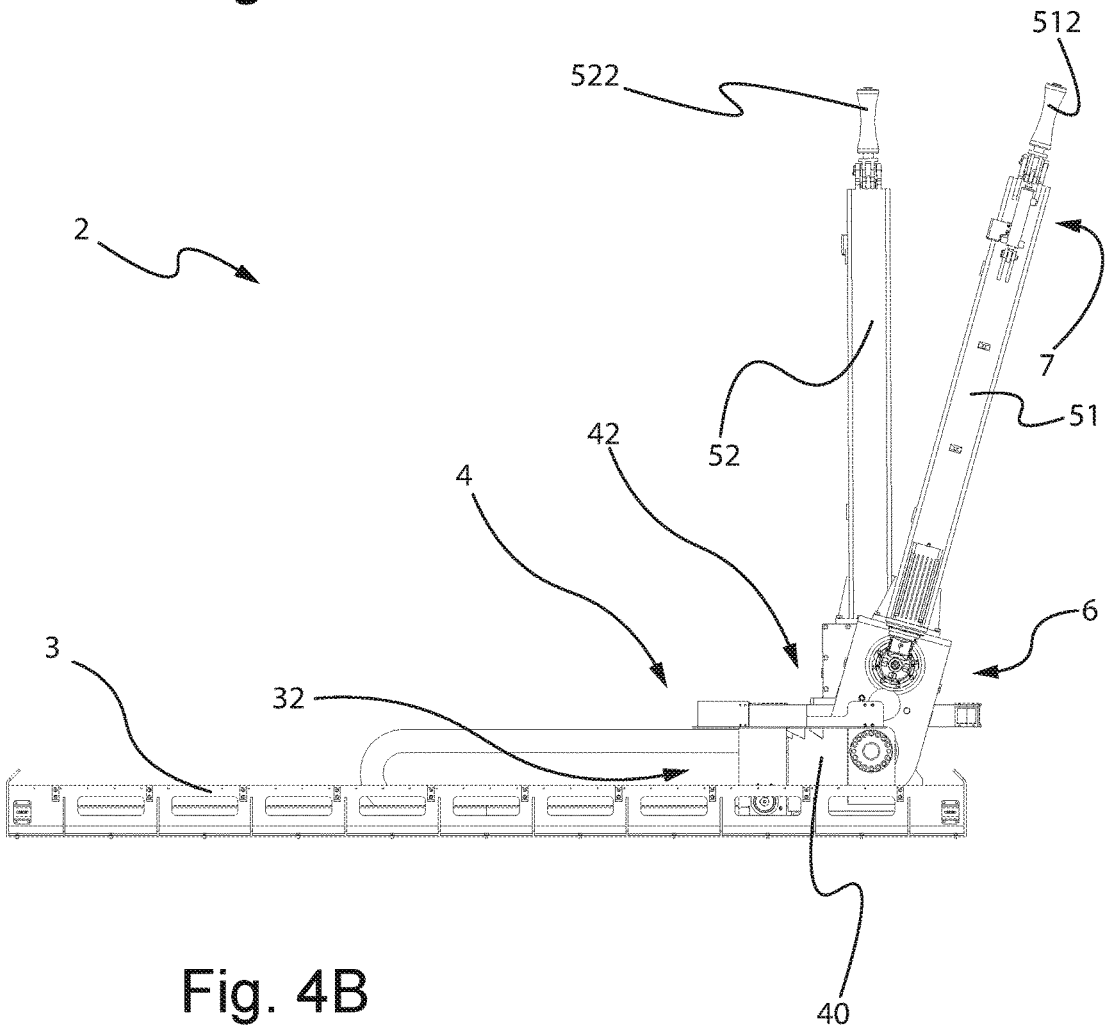

FIG. 4B shows a side view of stabilization manipulator 2 in the fifth operating configuration. When comparing FIGS. 4B and 3B, one can see that carriage 4 has reached the opposite end of linear guide 3.

Comparing the fifth operating configuration with the fourth operating configuration, only actuator 32 has been operated, e.g. by control system 22, in order to cause carriage 4 to slide along linear guide 3. The remaining actuators, e.g. handling devices 6, rotation system 42 and rotation devices 7, have not been operated, leaving their configuration unchanged.

Figure 5A:
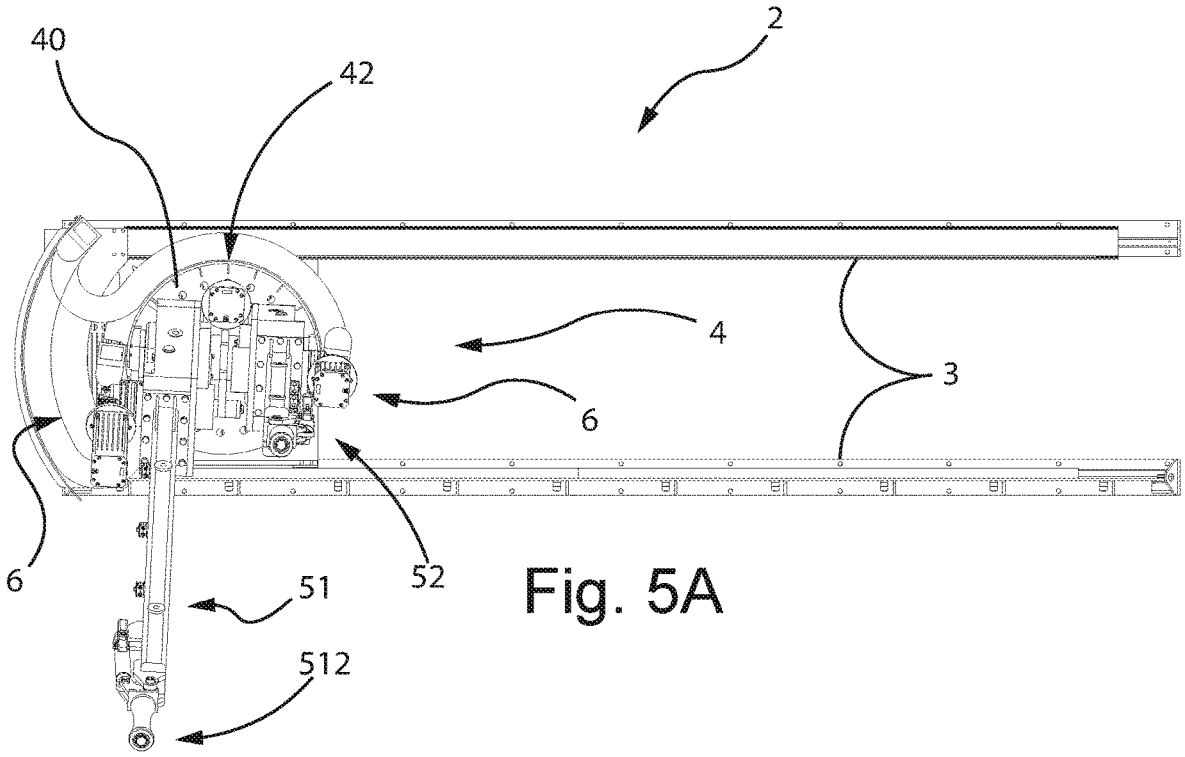
FIGS. 5A and 5B show the stabilization manipulator of FIG. 1A in a sixth operating configuration; in particular.

FIG. 5A shows a plan view from above of stabilization manipulator 2 of the preceding figures in a sixth operating configuration. As clearly visible when comparing FIGS. 5A and 2A, both handling devices 6 have been operated, e.g. by control system 22, in order to raise the arms (51, 52). More in particular, handling device 6 associated with the second arm 52 has been actuated to position said second arm at a greater angle than the first arm 51, which is handled by the respective handling device 6.

Figure 5B:
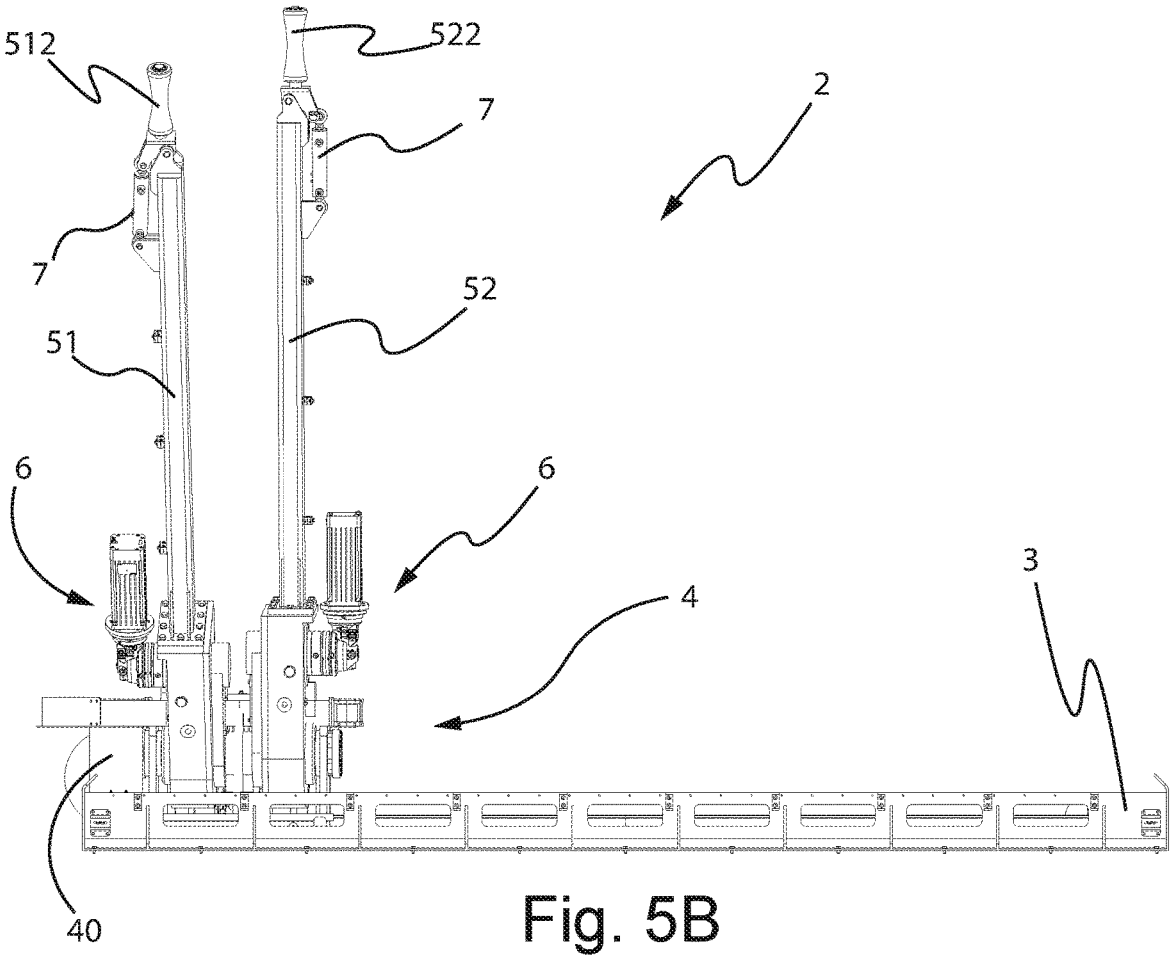

FIG. 5B shows a side view of stabilization manipulator 2 in the sixth operating configuration. In this figure, one can see further construction details of the arms (51, 52), handling devices 6 and base 40 to which the arms are constrained.

Comparing the sixth operating configuration with the second operating configuration, only handling devices 6 have been operated, e.g. by control system 22, in order to rotate the respective arms (51, 52) relative to base 40 they are constrained to. The remaining actuators, e.g. actuator 32, rotation system 42 and rotation devices 7, have not been operated, leaving their configuration unchanged.

Figure 6A:
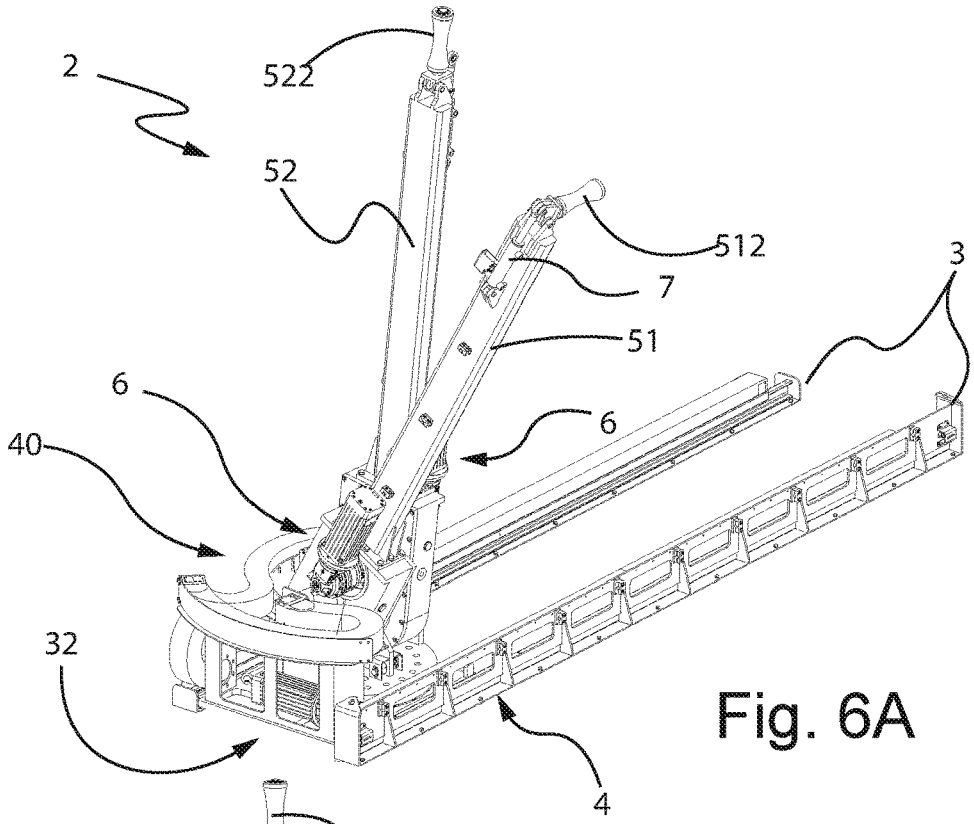
FIGS. 6A and 6B show the stabilization manipulator of FIG. 1A in a seventh operating configuration; in particular.
Figure 6B:
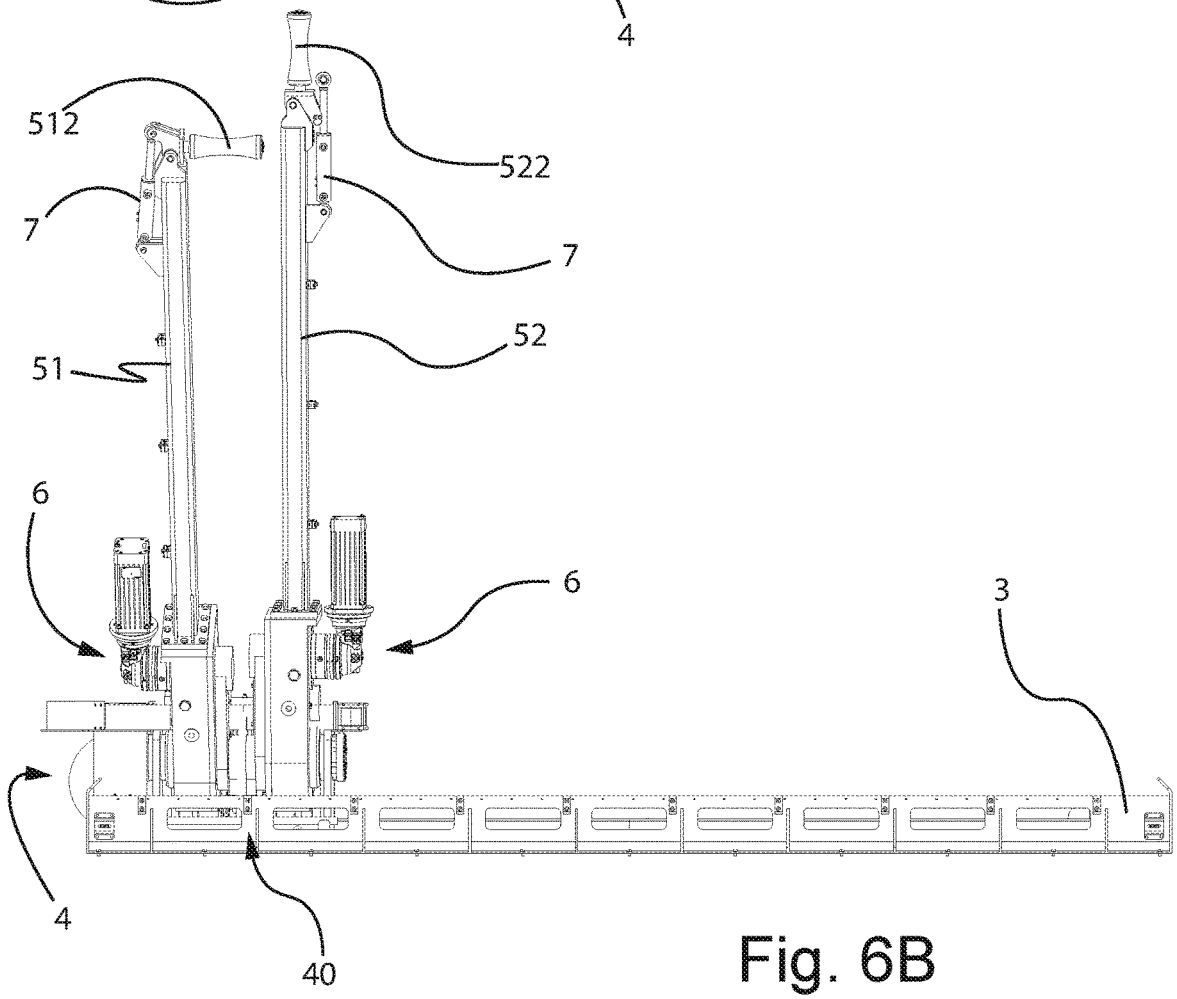

FIG. 6A shows a perspective front view of stabilization manipulator 2 of the preceding figures in a seventh operating configuration; whereas FIG. 6B shows a side view of stabilization manipulator 2 in the seventh operating configuration.

Comparing the seventh operating configuration with the sixth operating configuration, only rotation device 7 associated with the first arm 51 has been operated, e.g. by control system 22, to rotate the respective roller 512 in order to arrange said roller 512 perpendicular to the first arm 51. The remaining actuators, e.g. actuator 32, rotation system 42, handling devices 6 and rotation device 7 associated with the second arm 52, have not been operated, leaving their configuration unchanged.

More in general, the seventh operating configuration, or the specular one wherein rotation device 7 associated with the second arm 52 has been operated, or other similar configurations wherein carriage 4 has been moved along linear guide 3, are used in order to accompany a stand "S" of drilling elements into a housing 142 of fingerboard 14 and/or to extract it from said housing.

Figure 7B:
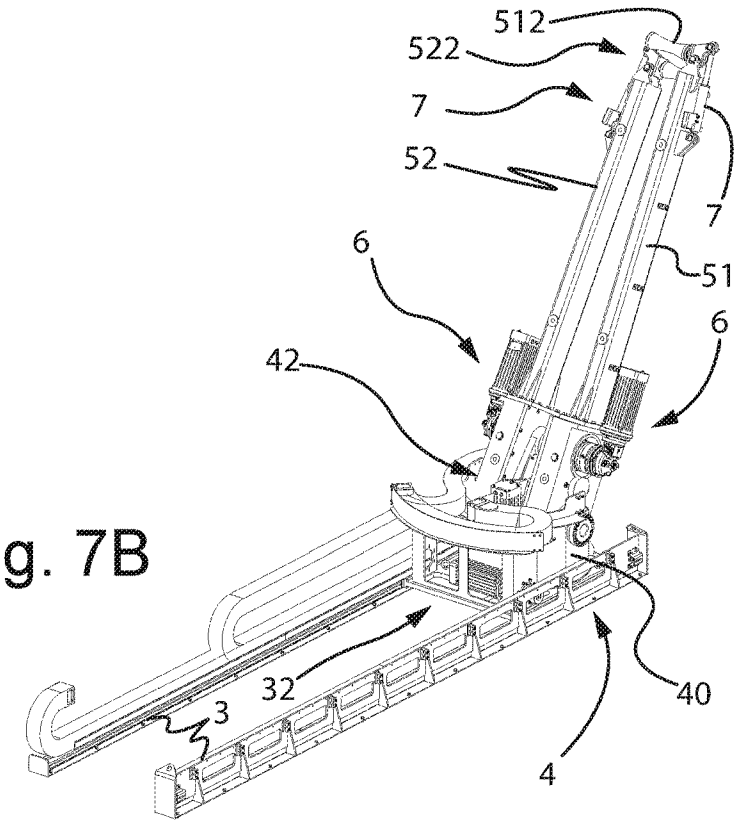
FIGS. 7A and 7B show the stabilization manipulator of FIG. 1A in different operating configurations; in particular.
Figure 7A:
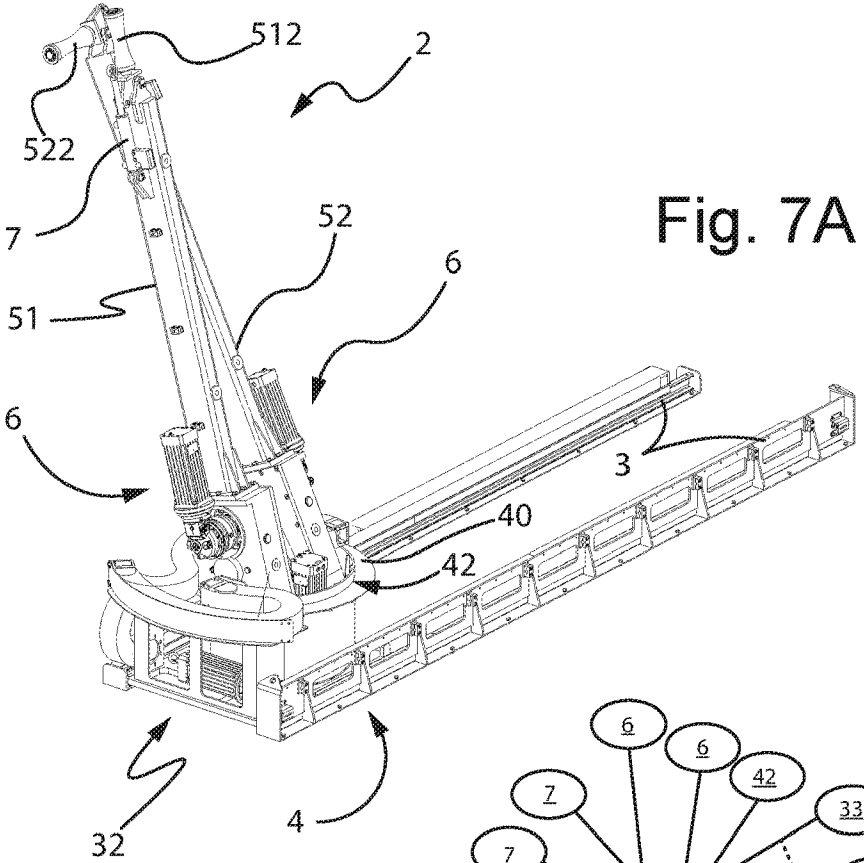

FIG. 7A shows a perspective front view of the stabilization manipulator in an eighth operating configuration. Comparing the eighth operating configuration with the seventh operating configuration, only the rotation system 42 has been activated, e.g. by control system 22, in order to cause base 40 of carriage 4 to rotate. The remaining actuators, e.g.

actuator 32, handling devices 6 and rotation devices 7, have not been operated, leaving their configuration unchanged.

More in general, the eighth operating configuration, or the specular one wherein rotation device 7 associated with the second arm 52 has been operated, or other similar configurations wherein carriage 4 has been moved along linear guide 3, are used in order to accompany a stand "S" of drilling elements into a housing 142 of fingerboard 14 and/or to extract it from said housing, in particular those housings 142 which are located on the opposite side of fingerboard 14 with respect to housings 142 that can be reached in the seventh operating configuration, or similar ones, of stabilization manipulator 2.

FIG. 7B shows a perspective front view of stabilization manipulator 2 in a ninth operating configuration. In this operating configuration, actuator 32 has been operated in order to position carriage 4 at the proximal end of linear guide 3. In this operating configuration, rotation system 42 is configured to set the arms (51, 52) in line with linear guide 3. In the same ninth operating configuration, handling devices 6 are configured to move the respective arms (51, 52) in order to put them into a configuration with an angle difference of 1° to 6°, preferably 4° to 5°. Moreover, in this configuration both rotation devices 7 have been operated in order to set both rollers (512, 522) perpendicular to the respective arms (51, 52). In this configuration, due to the disposition of the arms (51, 52), a housing is created between the rollers in which a drilling element "P" can be positioned in order to guide it during its movement, e.g. conducted by multifunction manipulator 8 of the manipulation system. In particular, in the ninth operating configuration said stabilization manipulator 2 can align at least one drilling element "P" with a well (H, M), e.g. a secondary well "M".

FIG. 8A shows a detail of a drilling rig 1 comprising a manipulation system, in turn comprising a multifunction manipulator 8 and a stabilization manipulator 2 according to the present invention, during a phase in which multifunction manipulator 8 grasps a drilling element "P" that has been placed on drill floor 13 by a lifting device or catwalk 16.

In the present embodiment, drilling element "P" is grasped by manipulation head 85 of multifunction manipulator 8. Drilling element "P" is positioned on drill floor 13 by lifting device or catwalk 16, at an angle of 3° to 4°, e.g. 3.5°, relative to drill floor 13. As drilling element "P" is lifted by multifunction manipulator 8, stabilization manipulator 2 arranges itself with the arms (52, 52) upwards, moved by the respective handling devices 6, in order to accompany the lifting action and preventing any slipping or oscillation. During the handling of drilling element "P", said drilling element "P" does not intersect the area of occupation of drill head 15. Once drilling element "P" has been lifted by the multifunction manipulator, with cooperation from stabilization manipulator 2, lifting device or catwalk 16 moves away to position another drilling element on drill floor 13.

FIG. 8B shows the positioning of a drilling element "P" into a secondary well or mousehole "M" by multifunction manipulator 8.

In FIG. 8B, stabilization manipulator 2 is in said first operating configuration. Before reaching such configuration to set the drilling rig into the configuration illustrated in FIG. 8B, stabilization manipulator 2 has accompanied drilling element "P" towards the secondary well "M". In particular, it has assumed an operating configuration similar to the ninth operating configuration illustrated in FIG. 7B, receiving between the rollers (512, 522) drilling element "P" handled by multifunction manipulator 8. This configuration of stabilization manipulator 2 remains unchanged until drilling element "P" is positioned vertically at the centre of the secondary well "M", after which stabilization manipulator 2 can switch into its first operating configuration.

FIG. 8C shows the positioning of a stand "S" of drilling elements "P" at well centre "H" from two viewpoints, i.e. one showing multifunction manipulator 8 and the other showing stabilization manipulator 2.

Stabilization manipulator 2 assumes an operating configuration similar to the ninth operating configuration illustrated in FIG. 7B, receiving between the rollers (512, 522) drilling element "P" positioned at well centre "H", for the purpose of accompanying its movements.

At the opposite end of stand "S", manipulation head 85 of multifunction manipulator 8 grasps drilling element "P", so that the latter can be moved.

FIG. 8D shows the positioning of a stand "S" of drilling elements "P" into a housing 142 in a fingerboard 14 from two viewpoints, i.e. one showing multifunction manipulator 8 and the other showing stabilization manipulator 2.

While switching between the configuration of the manipulation system shown in FIG. 8C and the configuration of the manipulation system shown in FIG. 8D, said manipulation system makes a rotation about a vertical axis. In order to be able to make such rotation, the multifunction manipulator operates a suitable actuator, e.g. a slewing ring, in order to turn robotic apparatus 84, and hence manipulation head 85, about a vertical axis. At the same time, stabilization manipulator 2 suitably operates rotation system 42 for rotating base 40. In order to execute this rotation, stabilization manipulator 2 and multifunction manipulator 8 are mutually aligned, so as to rotate about a common axis of rotation, e.g. by setting the slewing ring of multifunction manipulator 8 and the slewing ring of stabilization manipulator 2 into concentrical positions. Preferably, the other actuators of multifunction manipulator 8 and of stabilization manipulator 2 are not operated during the rotation, remaining in their initial configuration.

Referring back to FIG. 8D, after stand "S" has been positioned in a housing 142 of fingerboard 14, and before definitively depositing stand "S" of drilling elements "P" into housing 142, the roller located behind drilling element "P" is moved by rotation device 7 into a position parallel to the longitudinal axis of the respective arm. In order to facilitate the movement of the roller, the corresponding arm is moved by the respective handling device 6 by an angle smaller than 1°, e.g. 0.3°, so as to widen the housing generated between the rollers (512, 522).

The arm with the roller located in front of drilling element "P" is preferably moved by the corresponding arm to accompany and correctly position stand "S" of drilling elements "P" in housing 142, thus reaching the configuration shown in FIG. 8D.

Preferably, housings 142 of fingerboard 14 are occupied starting from the row closest to mast 12 and then moving away from it.

Figure 9:
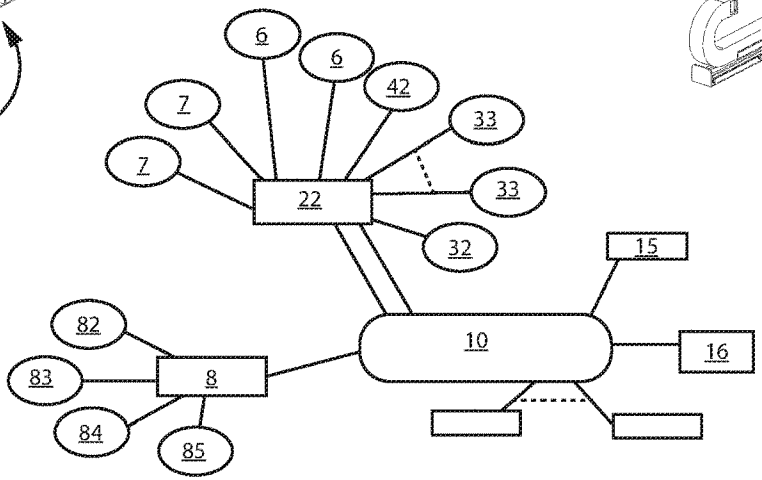
FIG. 9 schematically shows one possible representation of the control unit of the drilling rig, adapted to control the manipulation system.

FIG. 9 schematically shows one possible representation of control unit 10 of drilling rig 1, which is adapted to control the manipulation system. This figure shows, in a schematic manner, one possible representation of control unit 10 of drilling rig 1, adapted to control the manipulation system. In this figure one can see control system 22 of stabilization manipulator 2, which is electrically and/or electronically connected to the motors and/or actuators (42, 51, 52, 62A, 62B, 62C, 73) and/or sensors 33 and/or safety systems comprised in stabilization manipulator 2 in order to optimally control the latter. Said control system 22 is electronically connected to control unit 10 that controls the manipulation system and, more in general, the whole drilling rig 1. Said control unit 10 can coordinate stabilization manipulator 2 and multifunction manipulator 8 of the manipulation system, in particular by controlling the operation of the actuators for moving slide 82, articulated arm 83, robotic apparatus 84 and manipulation head 85. In addition, said control unit 10 controls the automation of drill head 15, of lifting device 16 and of other systems included in drilling rig 1.

In general, the manipulation system according to the present invention can be used for handling drilling elements "P", whether individual elements or multiple elements assembled into stands "S", during different operating phases of a drilling rig 1, i.e. both during the actual drilling phase, in order to quickly set drilling elements "P" into a position accessible to drill head 15, and during a preliminary phase, in order to assemble together several drilling elements "P" to create a stand "S" of drilling elements "P".

The present invention makes it possible to reduce the number of manipulators comprised in a drilling rig 1, thus simplifying the management of drilling rig 1.

The manipulation system according to the present invention permits reducing the number and contribution of human operators on both drill floor 13 and fingerboard 14. This increases the safety of drilling rig 1, reducing the number of accidents.

The manipulation system according to the present invention permits reducing those undesired effects that typically come from handling drilling elements "P" assembled into stands "S", and in particular any oscillatory effects that may cause accidents on drill floor 13 and on fingerboard 14. In addition, the present invention permits increasing the speed at which drilling elements "P" are moved, thus reducing the downtime of drilling rig 1, particularly during the drilling phase. In fact, the present invention reduces the risk of triggering an oscillatory motion of drilling elements "P", which in prior-art solutions was normally kept under control by moving drilling elements "P" very slowly.

The present invention makes it possible to increase the automation of drilling rigs 1, thus eliminating the risk of accidents that may involve human operators, in addition to reducing the downtime and simplifying the management of the drilling rig.

Such stabilization manipulator 2 is not a robotized arm, as normally employed in the manipulation systems currently known in the art. Stabilization manipulator 2 applies no loads onto drilling element "P", nor does it apply any pulling or pushing forces along the longitudinal axis of said drilling element "P".

Stabilization manipulator 2 is not designed to make high-precision movements, because its task is to accompany drilling element "P" or stand "S" of drilling elements "P" during the handling thereof.

Stabilization manipulator 2 is adapted to position itself in proximity to said second end of the linear guide 3 in order to limit the hindrance that it may cause during the execution of the typical procedures of drilling rig 1.

Moreover, such stabilization manipulator 2 has compact dimensions, thus reducing the space occupation on drill floor 13.

Any alternative embodiments not described in detail herein, as well as any combinations of technical features which can be easily inferred from the present description by a person skilled in the art, should be considered to fall within the scope of the present invention.

REFERENCE NUMERALS

Drilling rig 1
Control unit 10
Mast 12
Rails 121
Drill floor 13
Fingerboard 14
Housing 142
Drill head 15
Lifting device 16
Stabilization manipulator 2
Control system 22
Linear guide 3
Actuator 32
Sensors 33
Carriage 4
Base 40
Rotation system 42
First arm 51
Roller 512
Second arm 52
Roller 522
Handling device 6
Rotation device 7
Multifunction manipulator 8
Slide 82
Articulated arm 83
Robotic apparatus 84
Manipulation head 85
Well centre H
Secondary well M
Drilling elements P
Stand S
Second axis X
Third axis Y
First axis Z

The invention claimed is:

1. A stabilization manipulator for cooperation in manipulating and moving drilling elements in a drilling rig;

said stabilization manipulator comprising:

a linear guide adapted to be fixed to a drill floor in the drilling rig;

a carriage, comprising a base and sliding blocks, adapted to slide along said linear guide to move at least between a position proximate a well and a position distant from said well;

a first arm, a first end of which is constrained to said base of the carriage, said first arm being rotatable about a horizontal axis;

a second arm, a first end of which is constrained to said base of the carriage, said second arm being rotatable about a horizontal axis;

said second arm is separate from and independent of said first arm;

a first roller constrained to a second end of said first arm, which is adapted to rotate about an axis substantially perpendicular to an extension of said first arm, changing position relative to said first arm; a second roller being constrained to a second end of said second arm, which is adapted to rotate about an axis substantially perpendicular to an extension of said second arm, changing position relative to said second arm; said carriage comprising a rotation system adapted to rotate said base about a vertical axis;

said first arm has a greater longitudinal extension than said second arm;

wherein said first roller associated with said first arm and said second roller associated with the second arm have a substantially same size and shape to act evenly on drilling elements.

2. The stabilization manipulator according to claim 1, wherein said rotation system is adapted to rotate said base by 180° about a vertical axis.

3. The stabilization manipulator according to claim 1, wherein each of the first and second arms comprises a respective handling device adapted to rotate the corresponding arm by approximately 100° about a horizontal axis relative to said base.

4. The stabilization manipulator according to claim 1, wherein each of the first and second arms comprises a respective rotation device adapted to rotate the corresponding first or second roller by approximately 90° about a horizontal axis relative to the corresponding arm;

each of the first and second rollers being adapted to rotate idly about an associated longitudinal axis.

5. The stabilization manipulator according to claim 1, wherein said carriage comprises an actuator adapted to cause the sliding blocks to slide along said linear guide, the linear guide being a pair of rails.

6. The stabilization manipulator according to claim 1, wherein the actuators adapted to move the carriage and the arms are electric actuators.

7. A manipulation system for manipulating drilling elements in a drilling rig in the absence of human operators on a drill floor and/or on a fingerboard of said drilling rig;

said manipulation system comprising:

a multifunction manipulator for manipulating drilling elements in a drilling rig for assembling, disassembling and moving a stand of drilling elements, said multifunction manipulator being adapted to slide vertically along a first axis parallel to a longitudinal extension of a mast in the drilling rig;

a stabilization manipulator comprising:

a linear guide adapted to be fixed to a drill floor in the drilling rig;

a carriage, comprising a base and sliding blocks, adapted to slide along said linear guide to move at least between a position proximate a well and a position distant from said well;

a first arm, a first end of which is constrained to said base of the carriage, the first arm being rotatable about a horizontal axis;

a second arm, a first end of which is constrained to said base of the carriage, the second arm being rotatable about a horizontal axis;

said second arm is separate from the independent of said first arm;

a first roller constrained to a second end of said first arm, which is adapted to rotate about an axis substantially perpendicular to an extension of said first arm, changing position relative to said first arm; a second roller constrained to a second end of said second arm, which is adapted to rotate about an axis substantially perpendicular to an extension of said second arm, changing position relative to said second arm; said carriage comprising a rotation system adapted to cause said base to rotate about a vertical axis.

8. The manipulation system according to claim 7, wherein:

said multifunction manipulator is adapted to grasp, hold and release a first end of at least one drilling element or of a stand of drilling elements;

said stabilization manipulator is adapted to grasp and release a second end of the same at least one drilling element or of the same stand of drilling elements.

9. The manipulation system according to claim 7, comprising a control unit adapted to at least control relative motion of said stabilization manipulator and said multifunction manipulator to obtain mutually coordinated movements.

10. The manipulation system according to claim 7, wherein said multifunction manipulator comprises:

a slide adapted to slide along rails disposed along the longitudinal extension of the mast;

an articulated arm;

a robotic apparatus a manipulation head;

said robotic apparatus being adapted to move said manipulation head with at least three degrees of freedom;

said multifunction manipulator being configured to move said manipulation head with at least five degrees of freedom.

11. A drilling rig comprising:

a substructure adapted to be set at ground level where drilling will take place;

a mast extending along a vertical axis;

a drill floor set at a predefined height above the ground level, on top of the substructure;

a drill head adapted to slide along said mast; said mast comprising, at a predefined height above the drill floor, a fingerboard housing a plurality of drilling elements;

a lifting device adapted to move the drilling elements from the ground level to the drill floor, and vice versa;

the manipulation system according to claim 7.

12. The drilling rig according to claim 11, wherein said rig comprises automated systems and circuits.

13. A drilling rig comprising:

a substructure adapted to be set at ground level where drilling will take place;

a mast extending along a vertical axis;

a drill floor set at a predefined height above the ground level, on top of the substructure;

a drill head adapted to slide along said mast; said mast comprising, at a predefined height above the drill floor, a fingerboard housing a plurality of drilling elements;

a lifting device adapted to move the drilling elements from the ground level to the drill floor, and vice versa;

the manipulation system according to claim 7.

* * * * *